US006243084B1

(12) United States Patent
Nagai

(10) Patent No.: US 6,243,084 B1
(45) Date of Patent: Jun. 5, 2001

(54) METHOD FOR DRIVING PLASMA DISPLAY

(75) Inventor: Takayoshi Nagai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/061,163

(22) Filed: Apr. 17, 1998

(30) Foreign Application Priority Data

Apr. 24, 1997 (JP) ..... 9-107912

(51) Int. Cl.[7] ..... G09G 3/28

(52) U.S. Cl. ..... 345/210; 345/60; 345/62; 345/67; 345/68; 345/215; 315/167; 315/169.4

(58) Field of Search ..... 345/60, 67, 68, 345/204, 208, 210, 215, 62; 315/167, 169.4

(56) References Cited

U.S. PATENT DOCUMENTS 5,420,602 * 5/1995 Kanazawa ..... 345/67
5,610,623 * 3/1997 Takano et al. ..... 345/60
5,790,087 * 8/1998 Shigeta et al. ..... 345/67
5,854,540 * 12/1998 Matsumoto et al. ..... 315/169.1
5,982,344 * 11/1999 Tokunaga ..... 345/67
5,990,630 * 11/1999 Nakamura ..... 315/169.4

FOREIGN PATENT DOCUMENTS 7-160218 6/1995 (JP) .
8-314405 11/1996 (JP) .

* cited by examiner

*Primary Examiner*—Bipin Shalwala
*Assistant Examiner*—Vincent E. Kovalick

(57) ABSTRACT

Before applying a pulse (Vp) of the first voltage for uniforming charges between each of the first electrodes X and each of the second electrode Y1 to Yn which are adjacent to each other, a pulse (Vpp) of the fifth voltage which has a reverse polarity to that of the pulse of the first voltage and is lower than the pulse of the first voltage and higher than the pulse of the fourth voltage for sustaining a discharge is applied between the first and second electrodes. Thus, in a method for driving a plasma display in which cells are provided at intersections of a plurality of electrodes, a full write discharge is surely caused even if residual wall charges are left, and luminous efficiency is increased.

18 Claims, 23 Drawing Sheets

FIG.3($g_0$) IMMEDIATELY AFTER APPLICATION OF PREPRIMING PULSE
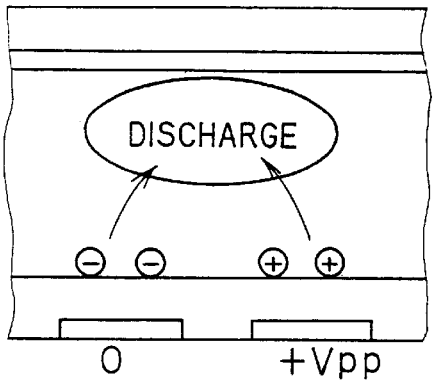
FIG.3($h_0$) DURING APPLICATION OF PREPRIMING PULSE
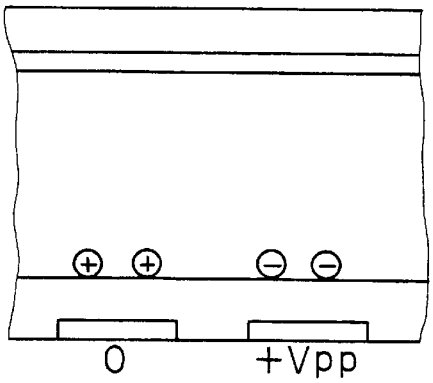
FIG.3($a_1$) AFTER APPLICATION OF PREPRIMING PULSE (BEFORE APPLICATION OF PRIMING PULSE)
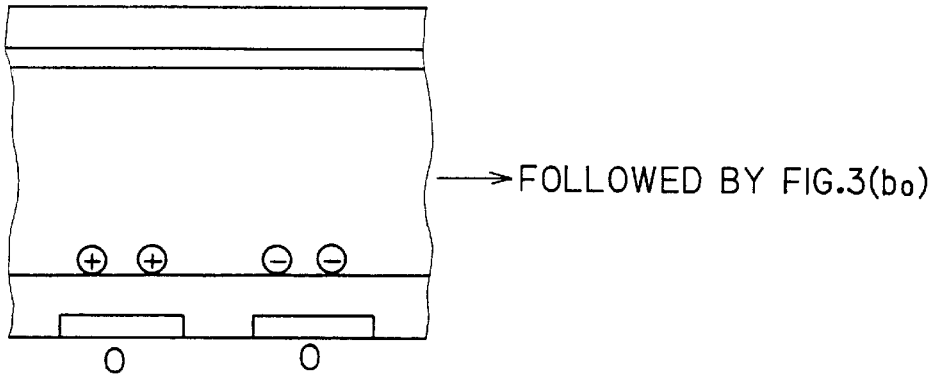

→ REPEAT FROM FIG.7(d)

THE SAME STATE AS IN FIG.7(c)

TO FIG.14(a1)

METHOD FOR DRIVING PLASMA DISPLAY

BACKGROUND OF THE INVENTION

1. Field of the Invention

The present invention relates to a method for driving a plasma display including cells defined at intersections of a plurality of electrodes.

2. Description of the Background Art

FIG. 11 shows an overview of a configuration of a background-art plasma display such as disclosed in Japanese Patent Application Laid Open Gazette 7-160218. This figure shows a display panel 101, sustain electrodes X serving as the first electrodes and scan electrodes Y1 to Yn serving as the second electrodes which are disposed in parallel on a glass substrate serving as the first substrate and address electrodes A1 to Am serving as the third electrodes arranged on a glass substrate serving as the second substrate opposed to the above-mentioned glass substrate in a direction perpendicular to the sustain electrodes X and the scan electrodes Y1 to Yn.

The plasma display has n×m pixels, that is i=1 to n and j=1 to m, and a discharge cell is defined at an intersection between a given scan electrode Yi and a given address electrode Aj. The scan electrodes Y1 to Yn and the address electrodes A1 to Am are insulated from and independent of one another so as to be independently driven to perform address selection for each of the defined discharge cells to turn on/off.

The sustain electrodes X are paired with the scan electrodes Y1 to Yn respectively and respective one ends of the sustain electrodes X are connected in common. The first to fourth voltages to be applied to these electrodes as pulses are generated by a power supply circuit 102 and then supplied for the electrodes through a Y common driver 103, a scan driver 104, an X common driver 105 and an address driver 106. The Y common driver 103, the scan driver 104, the X common driver 105 and the address driver 106 are controlled by a control signal from a control circuit 107. The control circuit 107 generates the control signal based on externally-supplied display data DATA, a dot clock CLK, a vertical synchronizing signal VSYNC and a horizontal synchronizing signal HSYNC in synchronization with the display data.

FIG. 12 is a cross-sectional illustration showing a structure of a cell in the plasma display panel. This figure shows the sustain electrode X and the scan electrode Yi both of which are formed on a glass substrate 108 extending in a direction perpendicular to this paper, a dielectric layer 109 for holding wall charges formed on the sustain electrode X and the scan electrode Yi, a protective layer 110 formed on a surface of the dielectric layer 109, the address electrode Aj formed on a glass substrate 111 opposed to the glass substrate 108, extending in a side-to-side direction of this paper, a phosphor 112 formed on the address electrode Aj, a barrier rib 113 formed on a pixel boundary and a discharge space 114 between the protective layer 110 and the phosphor 112, being filled with, for example, Penning mixed gas of Ne and Xe.

Now, an operation will be discussed.

FIG. 13 is an illustration of applied voltage waveforms for showing a background-art method for driving a plasma display, with a resetting step, a writing step and a discharge sustaining step in time series. In this figure, prior to the writing step, a priming pulse 121 is applied as a pulse of the first voltage between the sustain electrode X and the scan electrode Yi in the resetting step, to cause a discharge between the sustain electrode X and the scan electrode Yi, producing space charges in the discharge space 114, and to cause a self-erase discharge on a fall of the priming pulse 121, bringing a state of charges in the cell into a charge-erased state (where accumulated charges in the dielectric layer 109 on the sustain electrode X and the scan electrode Yi become zero). Subsequently, in the writing step, a scan pulse 122 is applied to the scan electrodes Y1 to Yn in sequence and an address pulse is applied to the address electrodes A1 to Am in accordance with the display data, to generate the second voltage across the address electrodes A1 to Am and the scan electrodes Y1 to Yn, causing a writing discharge. After that, in the discharge sustaining step, a sustain pulse is applied alternately to the sustain electrode X and the scan electrode Yi as the fourth voltage, to sustain the discharge.

The first voltage refers to a potential difference across the sustain electrode X and the scan electrode Yi. In FIG. 13, assuming that the potential of the scan electrode Yi is zero, a pulse of potential Vp is applied to the sustain electrode X and therefore Vp is the first voltage. Alternatively, for example, a pulse of potential Vpα and a pulse of negative potential Vpβ (where the first voltage=Vpα−Vpβ) may be applied to the sustain electrode X and the scan electrode Yi, respectively, as discussed later.

Similarly, the second voltage refers to a potential difference across the address electrode Aj and the scan electrode Yi (in FIG. 13, Va−Vsp is the second voltage, and since Vsp is a negative potential, the expression, |Va|+|Vsp| is the second voltage, may be made). The fourth voltage refers to a potential difference between the sustain electrode X and the scan electrode Yi (in FIG. 13, Vs is the fourth voltage). Thus, a display operation is achieved through repeating the resetting step, the writing step and the discharge sustaining step in sequence.

Next, with reference to FIGS. 14(*a*0) to 14(*f*0), discussion will be made on state changes inside a cell in the resetting step. FIGS. 14(*a*0) to 14(*f*0) correspond to time periods (a) to (f) of FIG. 13, respectively. After the end of the preceding driving cycle, in respective portions corresponding to the sustain electrode X and the scan electrode Yi which are adjacent to each other, a certain amount of wall charges of reverse polarities are accumulated (FIG. 14(*a*0)). In this state, when the priming pulse 121 is applied across the sustain electrode X and the scan electrode Yi, a discharge occurs across the sustain electrode X and the scan electrode Yi (FIG. 14(*b*0)). Electrons and positive ions generated by the discharge are attracted towards the reversely-polarized sustain electrode X and scan electrode Yi respectively and accumulated on a surface of the dielectric layer 109 to act as respective wall charges on the sustain electrode X and the scan electrode Yi. Since these wall charges reduce the electric field strength in the discharge space, the discharge immediately converges to a termination (FIG. 14(*c*0)).

When the application of the priming pulse 121 to the sustain electrode X and the scan electrode Yi is stopped, a discharge occurs across the sustain electrode X and the scan electrode Yi by the wall charges (FIG. 14(*d*0)). Then, the positive ions and the electrons recombine together, to reduce the wall charges (FIG. 14(*e*0)). At this time, the wall charges ideally become zero, but in some cases, some of the wall charges actually remain as residual wall charges (FIG. 14(*f*0)).

In the resetting step, the priming pulse 121 (full write pulse) applied across the sustain electrode X and the scan electrode Yi performs the following functions;

a. to once forcefully cause a discharge, regardless of the previous display state, resetting the state of the charges into a relatively uniform state, b. to generate space charges for easy subsequent discharges, and c. to perform an erase operation (to return all the discharge cells into an erased state, that is, a state of no accumulated charge).

With the above configuration of the background-art plasma display, all the wall charges are not necessarily erased by the self-erase discharge and some residual wall charges are left in some cases. Until now, it has been believed that it is no problem if the residual wall charges cause no false discharge in a cell of no writing, in other words, cause no erase failure in terms of quantity.

It is found, however, that the residual wall charges disadvantageously cause a problem of suppressing the priming discharge in the next driving cycle as well as causing the erase failure. The problem will be discussed with reference to FIGS. 14(*a*1) to 14(*b*1). When the cell in which the residual wall charges are left is a cell of no writing (off-cell), there is no chance to cause a discharge during writing and sustaining (FIG. 14(*a*1)). Therefore, when the priming pulse 121 is applied in the next cycle, the wall voltage by the residual wall charges offsets the externally-applied priming pulse voltage, and when a relation as (externally-applied voltage)−(wall voltage by residual charges)<(firing voltage of the cell)

is hold, no priming discharge occurs (FIG. 14(*b*1)).

If no discharge occurs when the priming pulse is applied, the priming pulse 121 does not accomplish its function, not leading to the next writing and sustaining discharge, and further no discharge occurs when the next priming pulse is applied, which is a vicious circle, resulting in a display failure.

The amount of residual charges depends on variation in discharge characteristics of the cell and stochastic fluctuation in intensity of the discharge, and these problems arise when the quantity of the residual charges are neither large nor small. Specifically, when small in quantity, a normal discharge occurs when the next priming pulse is applied. When large in quantity, though a false discharge occurs in writing or sustaining to cause an extra emission momentarily, a discharge occurs by applying the priming pulse in the next driving cycle, to reset the charges into a normal state.

With reference to FIG. 15, discussion will be made on the range of the wall voltage to cause an operation failure.

The vertical axis is a value of the wall voltage by the residual wall charges, and it is defined that the positive polarity (upward along the axis) represents a case where positive and negative residual wall charges are accumulated on a Y-electrode and an X-electrode, respectively, and the negative polarity (downward along the axis) represents a case where negative and positive residual wall charges are accumulated on the Y-electrode and the X-electrode, respectively. Therefore, the wall voltage of positive polarity means that the wall voltage is superimposed to aid the priming pulse 121.

Further, the voltage Vf is a firing voltage of the discharge space, and when the sum of the wall voltage and externally-applied voltage exceeds Vf, a discharge occurs. When the value of the residual wall charges is in a range that the voltage does not exceed the absolute value of Vf even if the priming pulse 121 is applied or the sustain pulse is applied, an operation failure may occur. To surely cause the full write discharge even if the residual wall discharges are left in such an amount, it is necessary to apply such a high priming pulse voltage as to offset the wall voltage by the residual charges and then exceed the firing voltage.

When the high priming pulse voltage is applied, however, there arises new problems of;

(1) causing a dielectric breakdown inside the plasma display panel, (2) raising cost due to the necessity for increasing a breakdown voltage of a driver circuit, and (3) enhancing background luminance (luminance in black display) due to the priming discharge and lowering the contrast ratio.

Though a model in which the residual wall charges are left due to the self-erase discharge on the fall of the priming pulse is discussed, other than that, there are problems of possibility of causing the same state of charges as above by incomplete writing and/or sustaining discharge, where priming discharge no longer occurs, and the like.

Another problem is difficulty in increasing luminous efficiency. There are some methods to increase luminous efficiency, and among them is to widen a space between the sustain electrode and the scan electrode. It is reported in, for example, "ASIA DISPLAY '95, Evaluations of Discharge Cell Structure for Color AC Plasma Display Panels" by T. Akiyama, M. Umeoka, that widening the space allows an increase in luminous efficiency. When the space between the sustain electrode and the scan electrode becomes wider, however, the firing voltage Vf rises at the same time and higher voltage is needed to drive. That results in a hard driving. The rise in firing voltage causes not only the rise in sustain voltage but also the rise in priming voltage.

The rise in priming voltage will be discussed with reference to FIGS. 16(*a*) to 16(*c*), 17 and 18. A voltage required as the priming voltage is indicated by a line of FIG. 16(*a*). In a region over the line, a good priming operation can be performed. This region is a synthesis of respective two regions defined over the lines of FIGS. 16(*b*) and 16(*c*). The line of FIG. 16(*b*) is expressed as $Vs+Vp=2\times Vf$. The region over the line, where it is possible to invert the residual wall charges by the sustain pulse 123 and the priming pulse 121, corresponds to a range of the sustain voltage Vs and the priming voltage Vp to eliminate "the range to cause an operation failure".

FIG. 16(*c*) shows a line where Vp is constant regardless of Vs ($Vp-a=Vf$: a is a constant), and in the region over the line, it is possible to cause a self-erase discharge on the fall of the priming pulse 121. Specifically, (Vp−a) indicates a value of the wall voltage by the wall charges accumulated on the rise of the priming pulse 121 and it is shown that the self-erase discharge occurs when this voltage exceeds the firing voltage. In a normal range of sustain voltage, whether the residual charges can be inverted or not mainly determines the minimum priming voltage.

It is assumed here that when the space between the electrodes is widened from g1 to g2 ($g2>g1$), the firing voltage changes from Vf1 to Vf2 (where $Vf2>Vf1$ and $Vf2-Vf1=\Delta Vf$). Then, as shown in FIG. 17, the priming voltage required to invert the residual charges rises by $2\times\Delta Vf$. Explanation for this is that with changes from +Vf1 to +Vf2 and from −Vf1 to −Vf2 as shown in FIG. 18, the required priming voltage changes from Vp1 to $Vp1+2\neq\Delta Vf$, rising by $2\times\Delta Vf$. Thus, when the firing voltage rises by $\Delta Vf$, the priming voltage rises by ($2\times\Delta Vf$), which is twice as large as the rise of the firing voltage, and therefore driving becomes harder.

For the above reason, conventionally, the space between the electrodes is determined near a value to make the firing voltage minimum, i.e., the minimum value of a curve known as Paschen's curve. Another well-known method for increasing luminous efficiency is to lower the intensity of one discharge and to increase the repeat number of discharges. In a pulse memory system of a DC plasma display, short pulses are applied in sequence in high repeat number.

In an AC plasma display, however, since the intensity of the discharge by one pulse depends on the panel structure and the applied voltage and the applied voltage is limited in a range of voltage which enables discharge sustaining, it is difficult to lower the luminous intensity. Moreover, since the discharge occurs only near the rise of the sustain pulse (see FIG. 19), it is necessary to increase the frequency of the sustain pulse in order to increase the repeat number of discharge. Then, it becomes impossible to ensure the duration (i.e., width) of the sustain pulse large enough to fully stabilize the wall charges, and that raises a problem of unstable operation.

SUMMARY OF THE INVENTION

The present invention is directed to a method for driving a plasma display having first and second substrates respectively defining first and second surface facing each other, electrode pairs disposed on the first surface and respectively defining parallel display lines, each of the electrode pairs pairing first and second electrodes parallel to each other, a dielectric layer covering the first and second electrodes for accumulation of wall charges on a surface thereof, the dielectric layer defining a space between the surface thereof and the second surface, and third electrodes disposed on the second surface and intersecting the electrode pairs without contact, wherein the space is filled with a discharge gas and discharge cells are respectively defined at intersections of the electrode pairs and the third electrodes.

In the present invention, the method comprises a repeating step of repeatedly executing a cycle, wherein the cycle includes: a resetting step of applying a pulse of a first voltage across the first and second electrodes so as to cause a discharge; a writing step of applying a pulse of a second voltage across the second electrode of one of the electrode pairs and one of the third electrodes corresponding to one of the cells to be turned on so as to cause a discharge and thereby accumulate first and second wall charges, which are reverse in polarity to each other and define a third voltage thereacross, on portions of the surface of the dielectric layer respectively over the first and second electrodes of the one of the electrode pairs; and a discharge sustaining step of applying an AC voltage pulse as a pulse of a fourth voltage across the first and second electrodes belonging to each one of the electrode pairs to thereby turn on any one of the cells where sum of the third and fourth voltages having same polarity exceeds a firing voltage defined across the first and second electrodes of each one of the electrode pairs and sustain discharge at the any one of cells alternately changing polarity of the first and second wall charges in response to alternate change of the fourth pulse in polarity.

According to a first aspect of the present invention, the method for driving the plasma display further comprises: an inserting step of inserting a prepriming step into the cycle, the prepriming step being a step of applying a pulse of a fifth voltage across the first and second electrodes belonging to each one of the electrode pairs after the discharge sustaining step and before the writing step, wherein the fifth voltage is in a range between the first and fourth voltage and is reverse to the first voltage in polarity.

According to a second aspect of the present invention, in the method of the first aspect, in the inserting step, the prepriming step is inserted immediately before the resetting step.

According to a third aspect of the present invention, in the method of the second aspect, the fifth voltage is lower than the firing voltage.

According to a fourth aspect of the present invention, in the method of the second aspect, a sum of the first and fifth voltage is at least twice as large as the firing voltage.

According to a fifth aspect of the present invention, in the method of the second aspect, the pulse of the fourth voltage applied immediately before application of the pulse of the fifth voltage is reverse to the pulse of the fifth voltage in polarity.

According to a sixth aspect of the present invention, in the method of the second aspect, in the inserting step, the prepriming step is inserted intermittently in repetition of the cycle.

According to a seventh aspect of the present invention, in the method of the second aspect, in the inserting step, the prepriming step is inserted every two to six cycles.

According to an eighth aspect of the present invention, the method for driving the plasma display further comprises: an polarity changing step of changing the first voltage in polarity during the repeating step alternately.

According to an ninth aspect of the present invention, in the method for driving the plasma display further, the fourth voltage is so set that the first and second wall charges caused by an application of the pulse of the fourth voltage define a voltage thereacross higher than the firing voltage, and a period from a trailing edge to a leading edge of the AC voltage pulse is set shorter than a decay time constant of space charges produced by a discharge arising at the trailing edge.

According to a tenth aspect of the present invention, in the method of the ninth aspect, the period is set not more than 1 $\mu$sec.

According to a eleventh aspect of the present invention, in the method of the ninth aspect, the method further comprises: an adjusting step of adjusting a product of a distance between the first and second electrodes and a pressure of the discharge gas to a value exceeding Paschen's minimum firing voltage prior to the repeating step.

According to a twelfth aspect of the present invention, in the method of the ninth aspect, the method further comprises: an inserting step of inserting a prepriming step into the cycle, the prepriming step being a step of applying a pulse of a fifth voltage across the first and second electrodes belonging to each one of the electrode pairs after the discharge sustaining step and before the writing step, wherein the fifth voltage is in a range between the first and fourth voltage and is reverse to the first voltage in polarity.

According to a thirteenth aspect of the present invention, in the method of the twelfth aspect, in the inserting step, the prepriming step is inserted immediately before the resetting step.

In the method of the first aspect of the present invention, since a pulse of a fifth voltage is applied across the first and second electrodes after the discharge sustaining step and before the writing step, i.e. before or after application of the pulse of the first voltage, and the fifth voltage is set lower than the first voltage for uniforming charges and higher than the fourth voltage for sustaining the discharge and is reverse to the first voltage in polarity, a priming discharge is effectively caused even if the wall charges are left. Moreover, since the priming voltage can be set relatively low, it is possible to improve the contrast ratio, to prevent a dielectric breakdown, to reduce a manufacturing cost of a driving circuit, and so on.

In the method of the second aspect of the present invention, since the pulse of the fifth voltage is applied before application of the pulse of the first voltage, a priming discharge is surely caused even if the wall charges are left, to ensure a stabilized operation. Moreover, since the priming voltage can be further lowered, the effects of increasing the contrast ratio, preventing a dielectric breakdown, achieving the driving circuit at low cost and so on are more prominent.

In the method of the third aspect of the present invention, since the pulse of the fifth voltage is determined lower than the firing voltage between the first and second electrodes, the discharge occurs in only problematic cells, not all the cells, to prevent deterioration in contrast.

In the method of the fourth aspect of the present invention, since the sum of the pulse of the fifth voltage and the pulse of the first voltage is twice as high as the firing voltage or more, regardless of the value of the residual wall charges, the discharge can be surely caused by at least one of the pulses of the fifth voltage and the first voltage, to ensure a stabilized operation.

In the method of the fifth aspect of the present invention, since the polarity of the pulse of the fourth voltage applied immediately before application of the pulse of the fifth voltage is reverse to that of the pulse of the fifth voltage, the full write discharge can be surely caused in the resetting step.

In the method of the sixth aspect of the present invention, since the pulse of the fifth voltage is inserted intermittently in applications of the pulse of the first voltage, the full write discharge can be surely caused in the resetting step, without deterioration in contrast.

In the method of the seventh aspect of the present invention, since the pulse of the fifth voltage is inserted every two to six applications of the pulse of the first voltage, the full write discharge can be surely caused in the resetting step, without deterioration in contrast.

In the method of the eighth aspect of the present invention, since the first voltage is changed alternately in polarity during repetition of the cycle including the resetting, writing, and discharge sustaining steps, the full write discharge can be surely caused in the resetting step, without using a special voltage, i.e., the fifth voltage.

In the method of the ninth aspect of the present invention, since the fourth voltage of the AC pulse is a voltage allowing the wall voltage which is raised by the discharge caused by the rise of the pulse of the fourth voltage to exceed the firing voltage across the first and second electrodes and the time elapsed from a fall (i.e., a trailing edge) of the pulse of the fourth voltage to a next rise (i.e., a following leading edge) of the pulse of the fourth voltage of reverse polarity is shorter than the time elapsed before decay of space charges raised by the discharge on the fall of the pulse of the fourth voltage, high luminous efficiency can be achieved.

In the method of the tenth aspect of the present invention, since the time elapsed from a fall of the pulse of the fourth voltage to a rise of a next pulse of the fourth voltage of reverse polarity is 1 $\mu$sec or less, a stabilized operation can be achieved.

In the method of the eleventh aspect of the present invention, since the product of the distance between the first and second electrodes and pressure of the gas which fills the space is larger than the value of Paschen's minimum firing voltage, the discharge can be surely caused on the fall of the fourth voltage.

In the method of the twelfth aspect of the present invention, since a pulse 5 of a fifth voltage is applied across the first and second electrodes after the discharge sustaining step and before the writing step, i.e. before or after application of the pulse of the first voltage, and the fifth voltage is set lower than the first voltage and higher than the fourth voltage and is reverse to the first voltage in polarity, the priming voltage can be set relatively low. As a result, it is possible to improve the contrast ratio, to prevent a dielectric breakdown, to reduce a manufacturing cost of a driving circuit, and so on.

In the method of the thirteenth aspect of the present invention, since the pulse of the fifth voltage is applied before application of the pulse of the first voltage, the pulse of the first voltage can be further lowered, and therefore effects of increasing the contrast ratio, preventing a dielectric breakdown, achieving the driving circuit at low cost and so on are more prominent.

An object of the present invention is to provide a method for driving a plasma display, by which a full write discharge can be surely caused even if residual wall charges are left.

Another object of the present invention is to increase luminous efficiency of the plasma display.

These and other objects, features, aspects and advantages of the present invention will become more apparent from the following detailed description of the present invention when taken in conjunction with the accompanying drawings.

DESCRIPTION OF THE PREFERRED EMBODIMENTS

Discussion will be presented below on preferred embodiments of the present invention.

The First Preferred Embodiment

Figure 1:
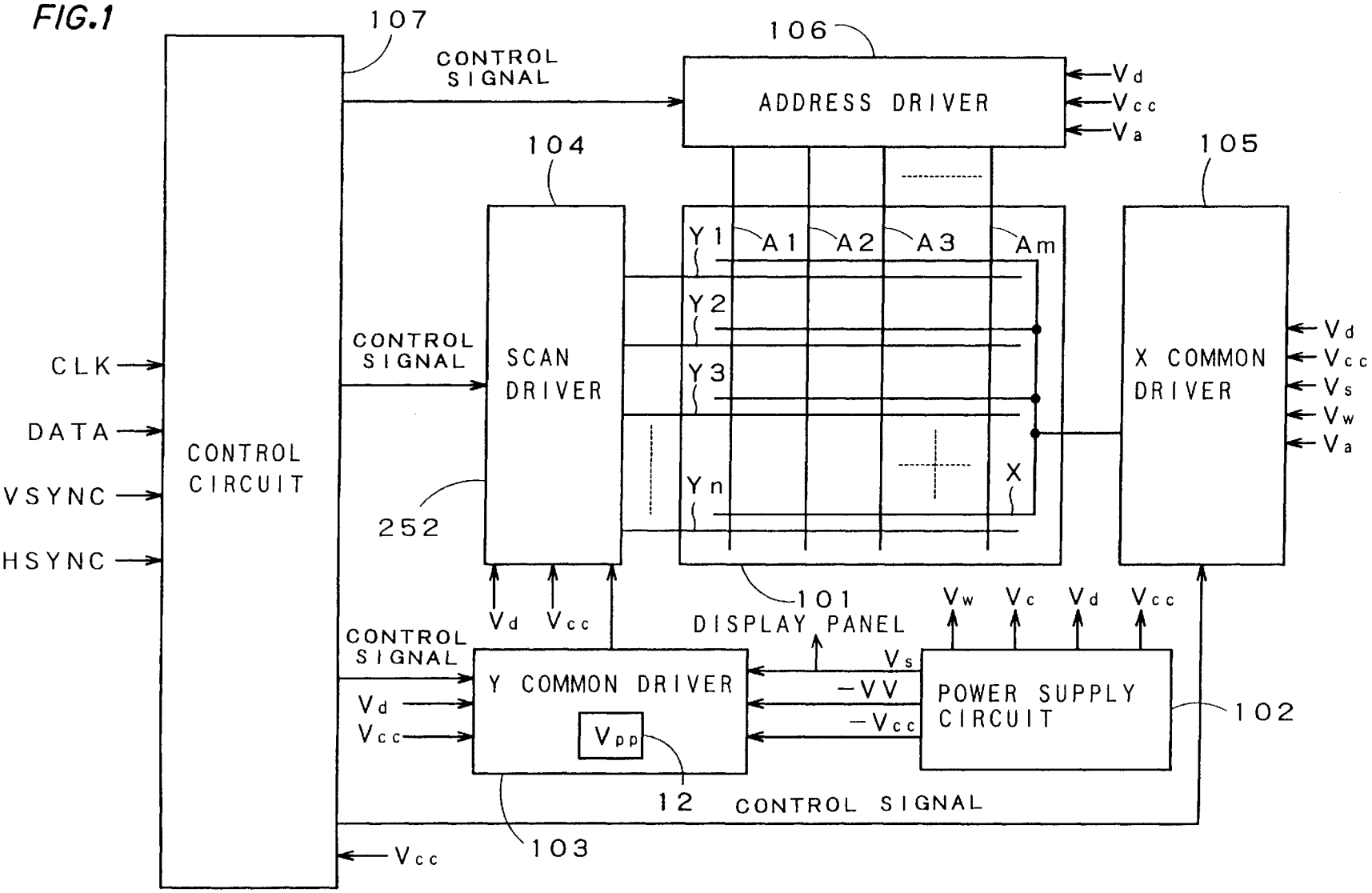
FIG. 1 shows an overview of a configuration of a plasma display in accordance with a first preferred embodiment of the present invention.

FIG. 1 is a block diagram showing an overview of a configuration of a plasma display in accordance with the first preferred embodiment of the present invention. In the plasma display of FIG. 1, a prepriming pulse generation circuit 12 is provided in the Y common driver 103. The prepriming pulse generation circuit 12 generates a prepriming pulse 124 discussed later, which is a characteristic constituent of this preferred embodiment.

The prepriming pulse generation circuit 12 may be constituted of conventionally-known circuits such as high voltage switching circuits using transistors, like the priming pulse generation circuit (not shown) for generating the priming pulse in the X common driver 105. Needless to say, the prepriming pulse generation circuit 12, which is a part of the Y common driver 103, is controlled by the control signal from the control circuit 107, as is clear from the discussion with reference to FIG. 11. Other constituents are the same as those of the background-art plasma display of FIG. 11, so discussion thereof will be omitted.

Figure 2:
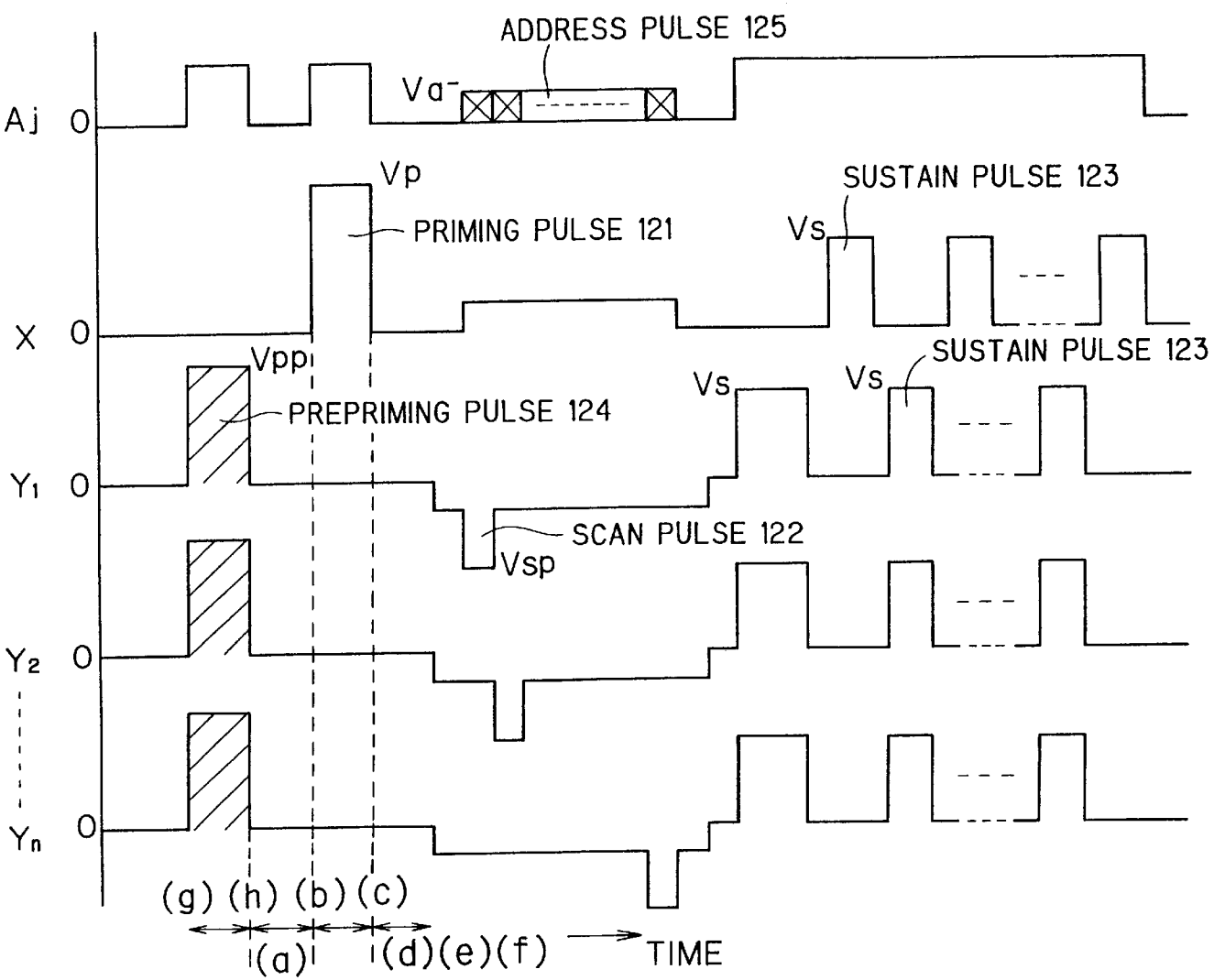
FIG. 2 is an illustration of applied voltage waveforms for showing a method for driving a plasma display in accordance with the first preferred embodiment of the present invention.

FIG. 2 is an illustration of applied voltage waveforms for showing a method for driving the plasma display of FIG. 1. This figure shows a period of one driving cycle, corresponding to a period of one subfield in a subfield gradation method usually used for gradation display of the plasma display. The first preferred embodiment is different from the background art in that the pulse 124 for inverting the residual charges as a pulse of the fifth voltage before the priming pulse 121. The application of the prepriming pulse 124 may be made every application of the priming pulse 121 or every a plurality of applications of the priming pulse.

Figure 3:
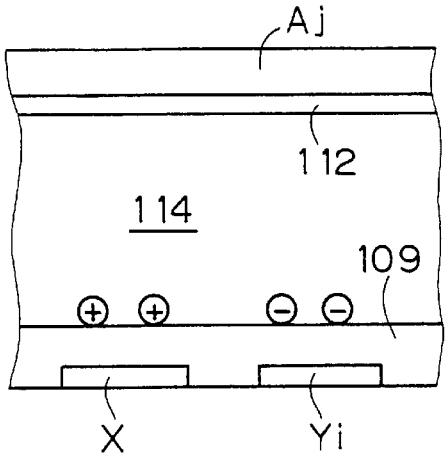
FIGS. 3(*a*0) to 3(*h*0) and 3(*a*1) illustrate generation of residual wall charges for showing a principle of the first preferred embodiment of the present invention.
Figure 3:
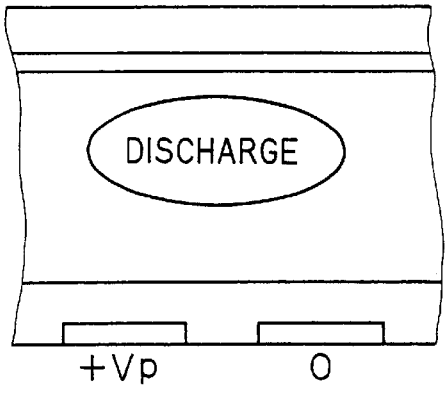
Figure 3:
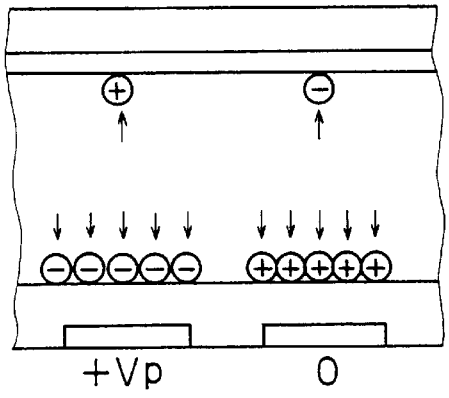
Figure 3:
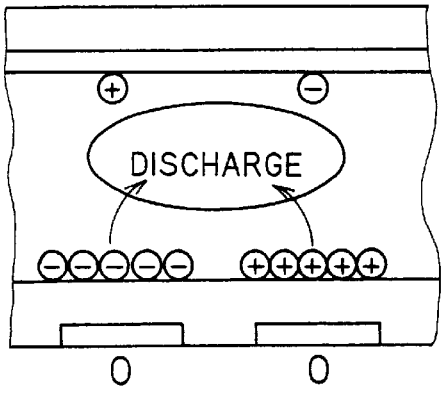
Figure 3:
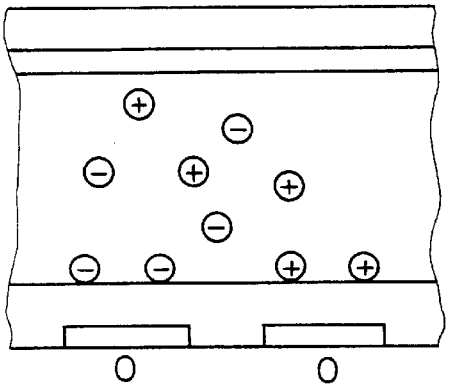
Figure 3:
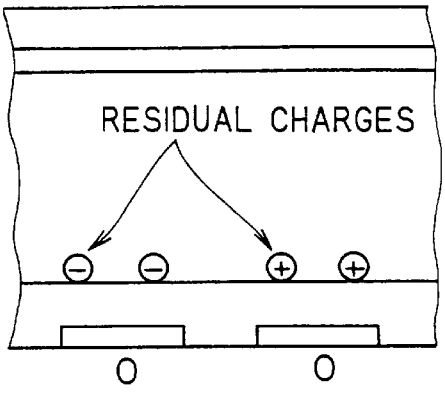
Figure 14:
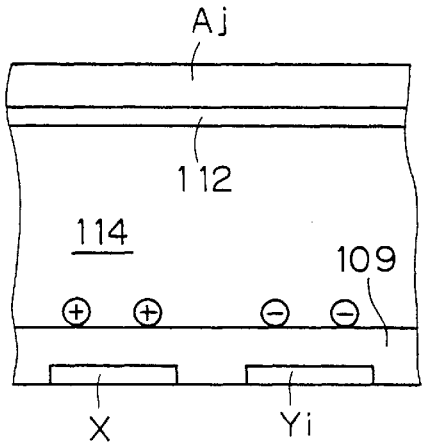
FIGS. 14(*a*0) to 14(*f*0), 14(*a*1) and 14(*b*1) illustrate generation of residual wall charges in the background art.
Figure 14:
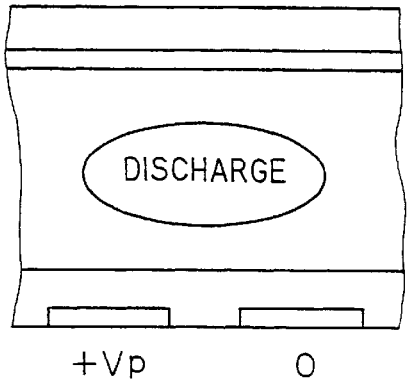
Figure 14:
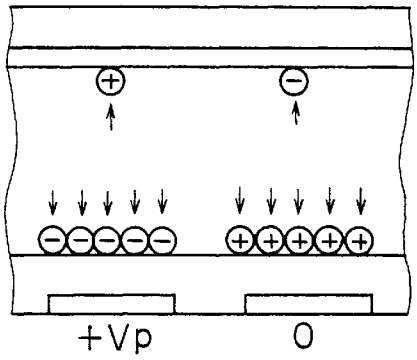
Figure 14:
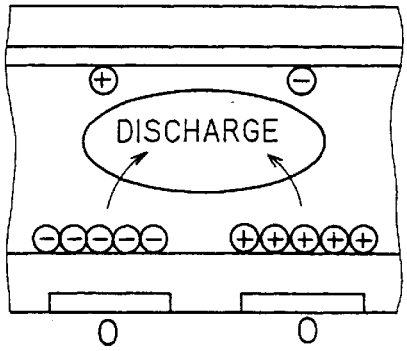
Figure 14:
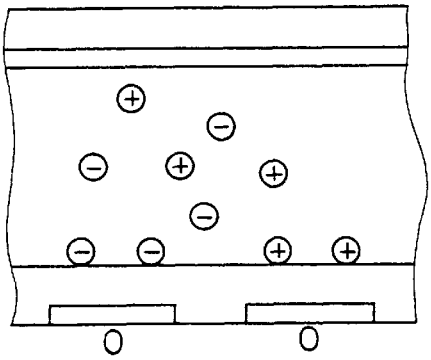
Figure 14:
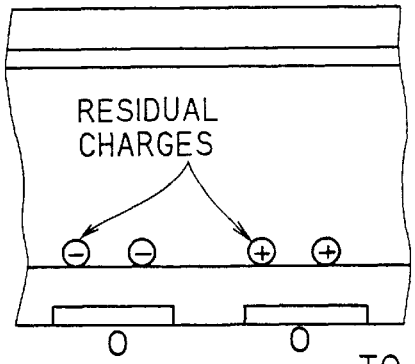
Figure 14:
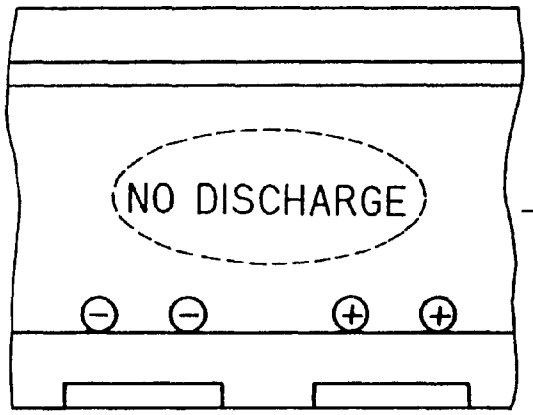
Figure 14:
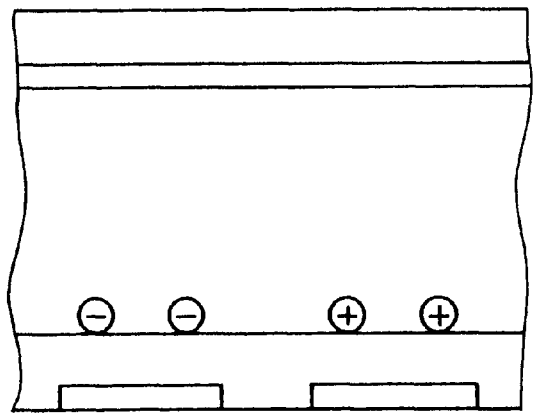
Figure 15:
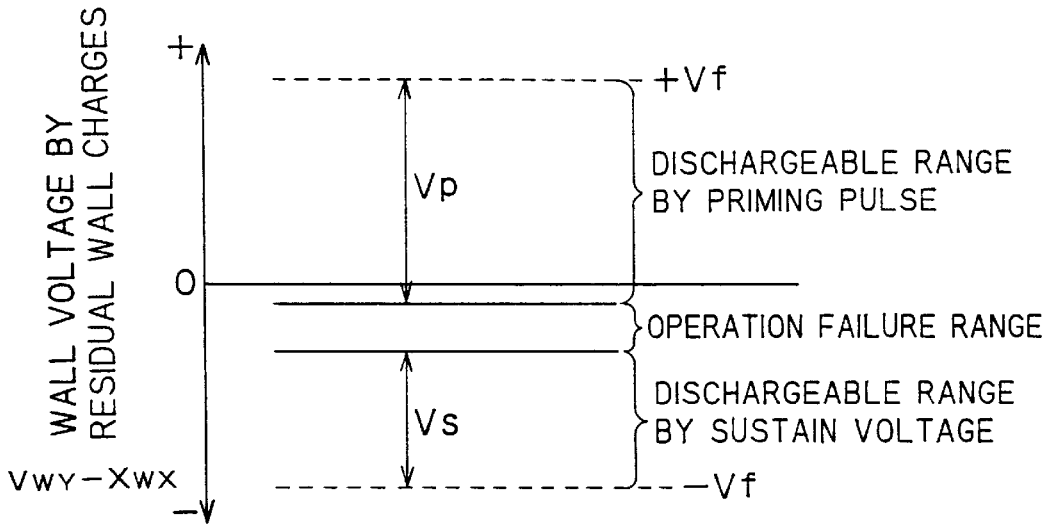
FIG. 15 shows a range of wall voltage to cause an operation failure.
Figure 16:
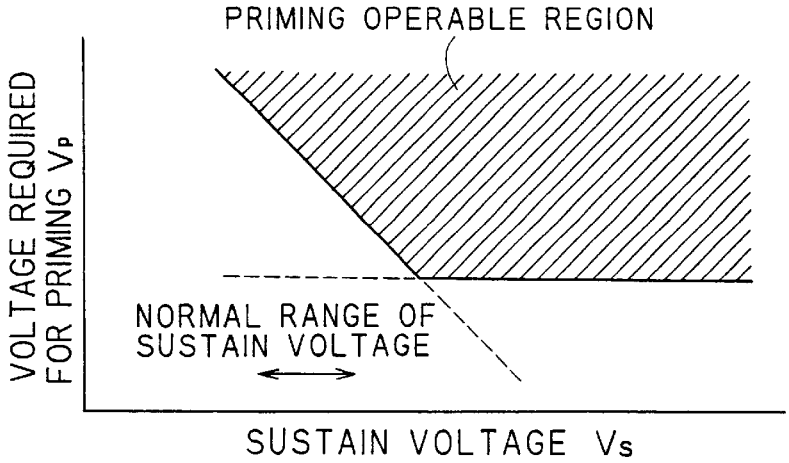
FIGS. 16(*a*) to 16(*c*) shows a relation between the sustain voltage and the priming voltage in the background-art plasma display.
Figure 16:
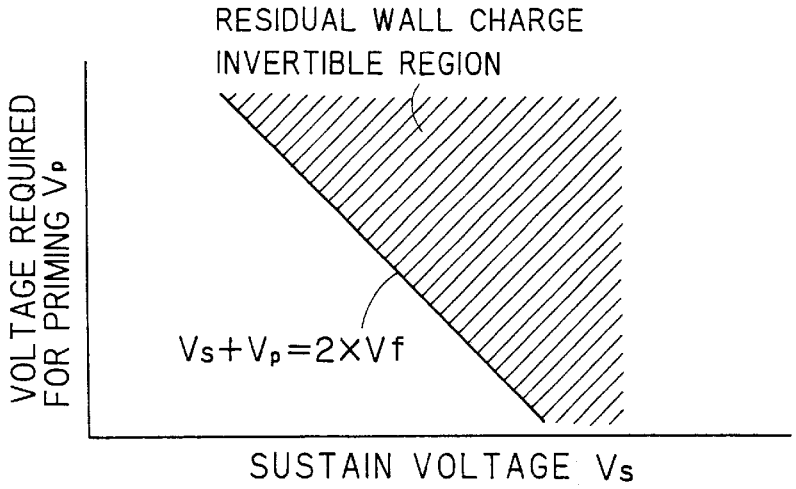
Figure 16:
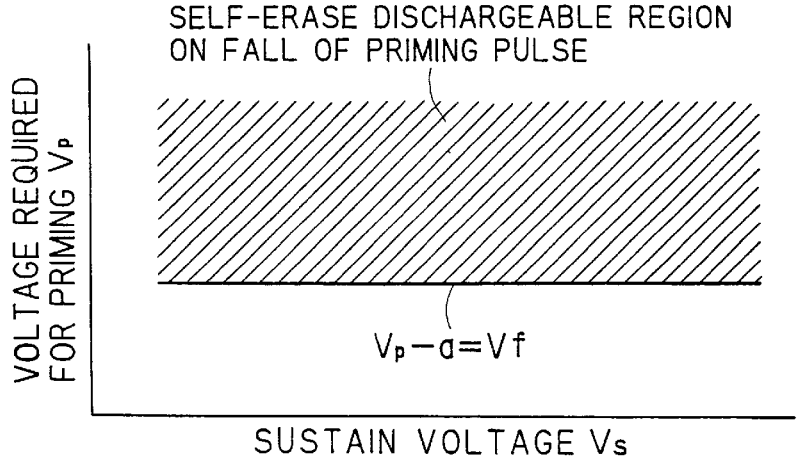
Figure 17:
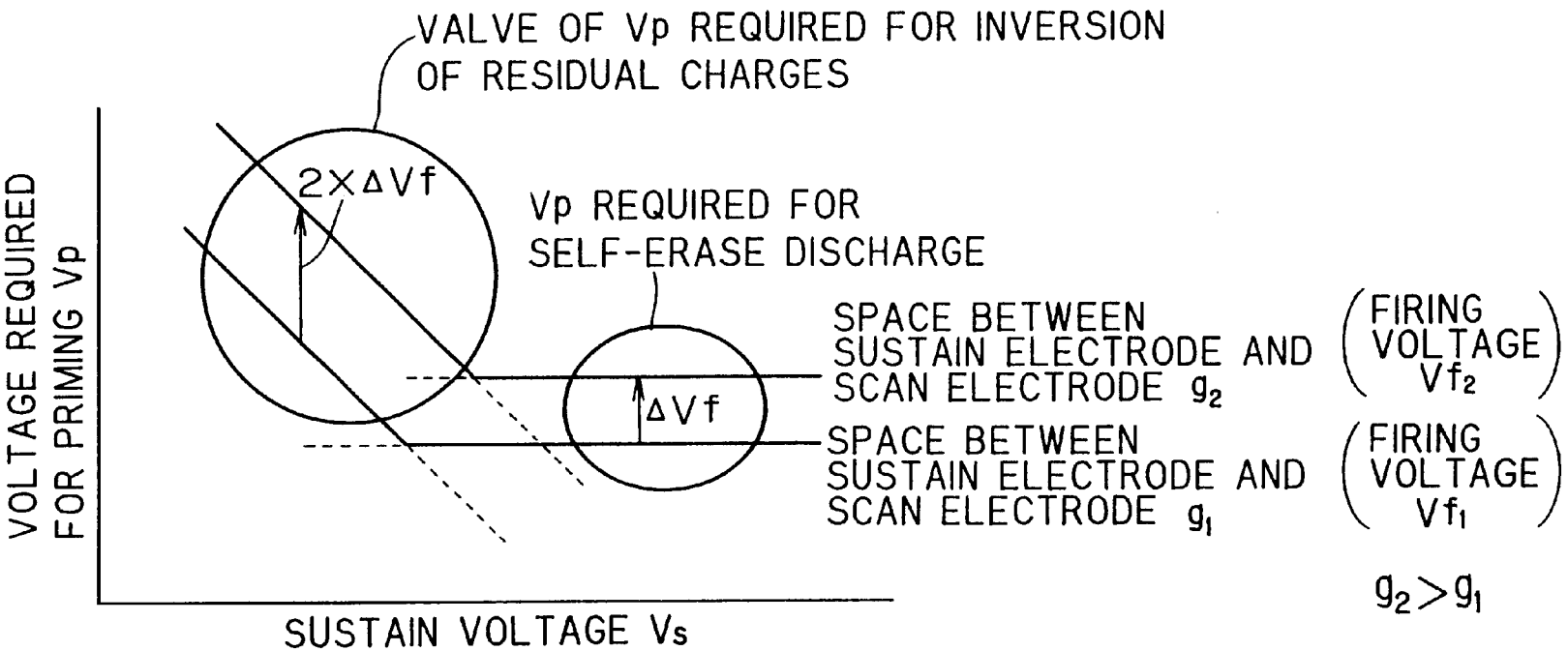
FIG. 17 shows a relation between the sustain voltage and the priming voltage when the space between the sustain electrode and the scan electrode is widened.
Figure 18:
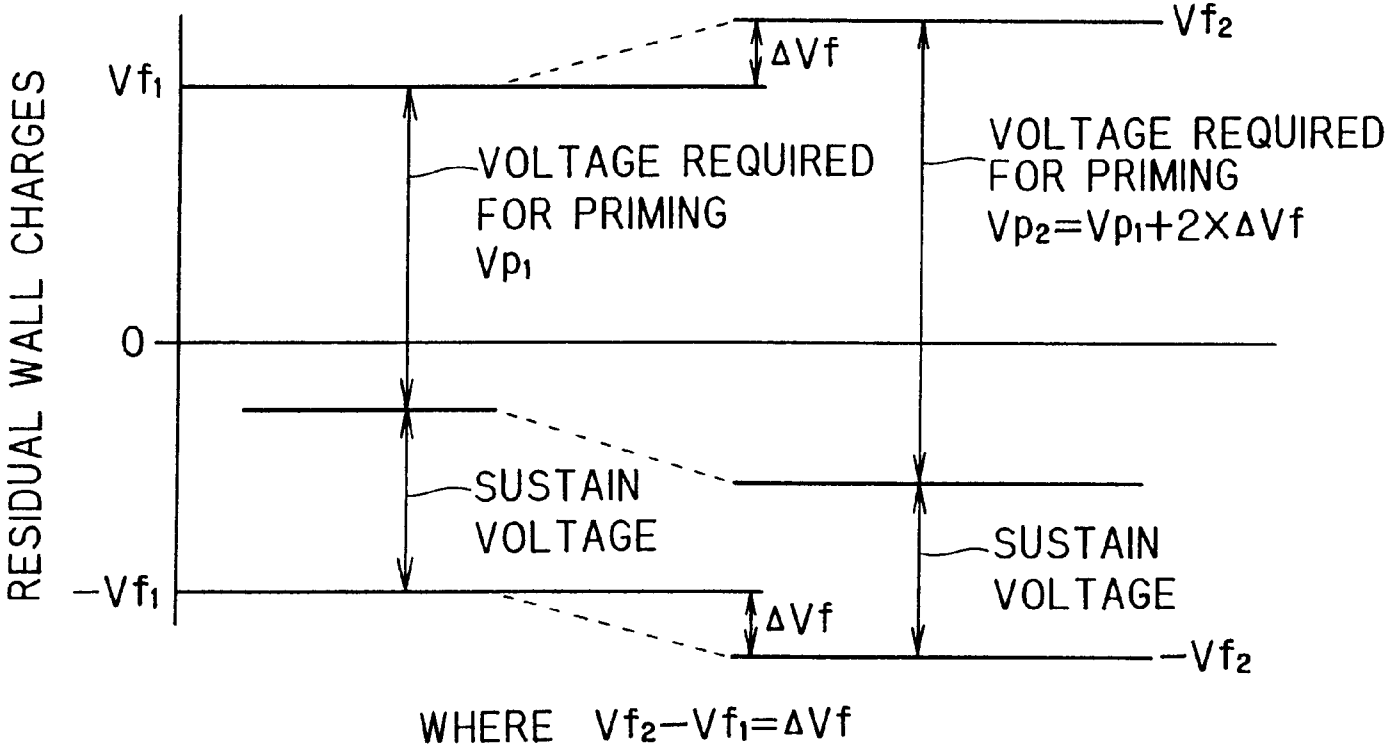
FIG. 18 shows a relation between the residual wall charges and the priming voltage.
Figure 19:
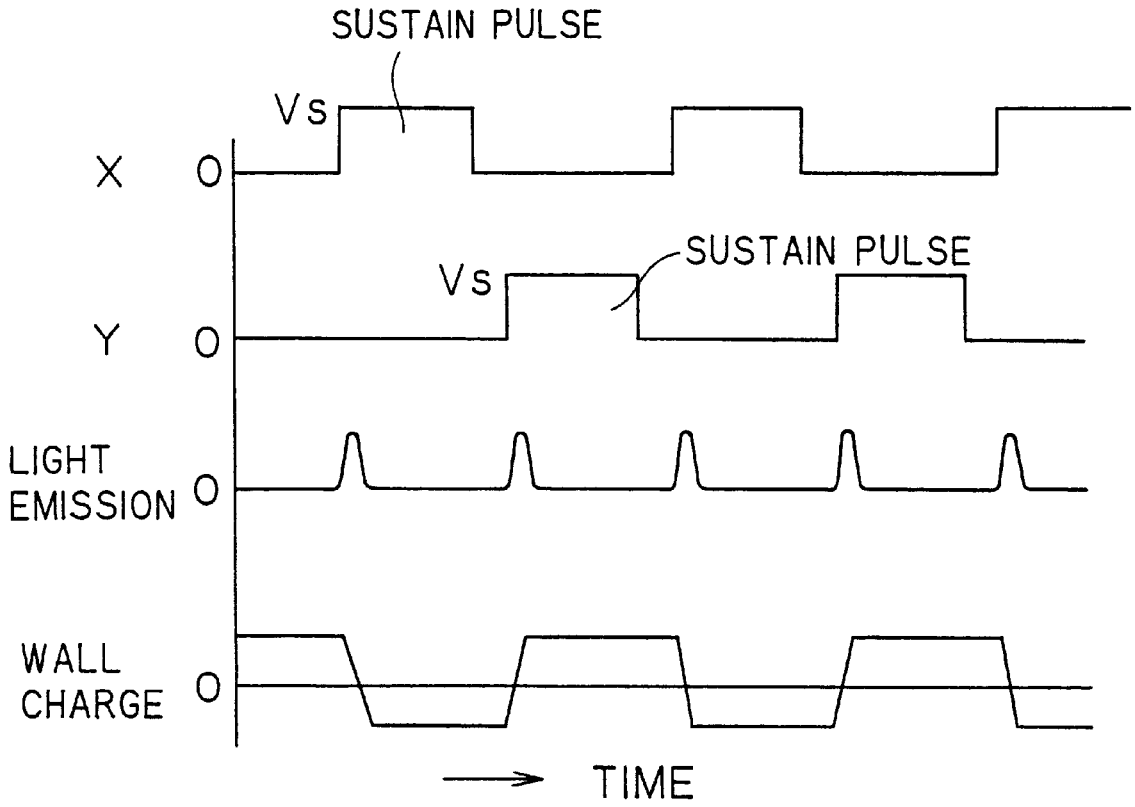
FIG. 19 is a timing chart showing a luminous condition in the background-art plasma display.

FIGS. 3(*a*0) to 3(*h*0) and 3(*a*1) illustrate generation of wall charges for showing a principle of the first preferred embodiment of the present invention, and the operation of FIGS. 3(*a*0) to 3(*f*0) is the same as that of the background-art driving method of FIGS. 14(*a*0) to 14(*f*0). The prepriming pulse 124 redischarges the residual wall charges accumulated in a direction of blocking the priming discharge, to invert the polarity into a direction of aiding the priming discharge. By applying the prepriming pulse 124, the residual wall charges of the polarity shown in FIG. 3(*f*0) is inverted as shown in FIG. 3(*g*0), eventually into the state of FIG. 3(*h*0).

The prepriming pulse 124 meets conditions (differences from other pulses in voltage, polarity and the like) given below:

(1) to have a reverse polarity (in terms of potential difference across the sustain electrode X and the scan electrode Yi) to that of the priming pulse 121 as the first voltage pulse in order to invert the wall charges accumulated in a direction of offsetting the priming pulse 121, (2) to be higher in voltage than the sustain pulse 123 as the fourth voltage, and otherwise useless since charges which can be inverted by a voltage almost equal to the sustain voltage should be already inverted when the sustain voltage is applied, and (3) to be lower in voltage than the priming voltage since the object of application of the prepriming pulse is to invert only wall charges which are large enough to block the priming discharge and application of a voltage higher than needed causes discharges in all the cells, to deteriorate the contrast (equivalent to just the application of two priming pulses 121).

Figure 4:
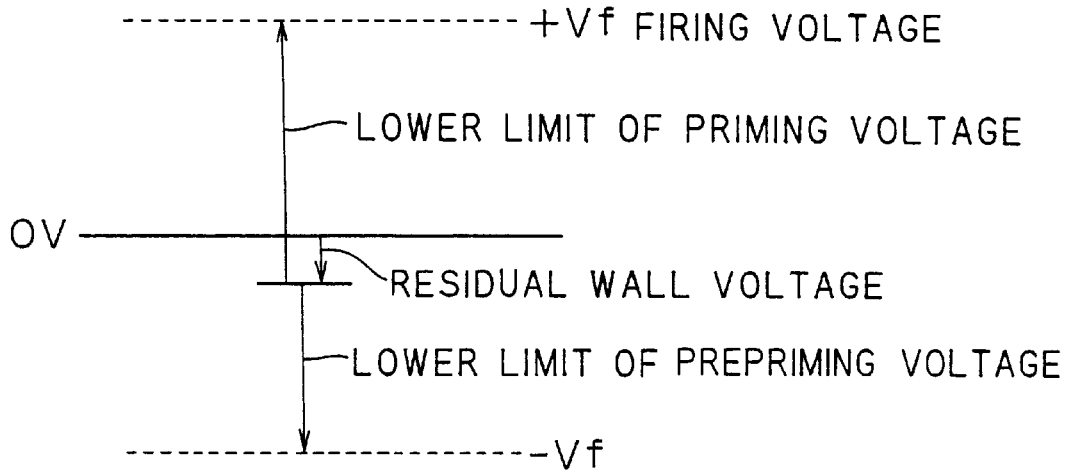
FIG. 4 shows a relation between a prepriming voltage +a priming voltage and a firing voltage.

With respect to the above conditions (2) and (3), more desirable value is defined as small as possible to satisfy the condition of FIG. 4 in all the cells. The condition is $$(\text{prepriming voltage})+(\text{priming voltage})\geqq 2\times(\text{firing voltage})$$

If this condition is satisfied, a discharge can be caused by either the priming pulse 121 or the prepriming pulse 124, regardless of the residual wall charges. The firing voltage in the above form is one at the time when the wall voltage is not accumulated.

Thus, even if the residual charges which suppress the priming pulse 121 are left, by applying the prepriming pulse 124, the charges are inverted and a discharge can be surely caused by a relatively low priming pulse 121. Further, even when the space between the sustain electrode and the scan electrode is widened to raise the firing voltage in the discharge space by $\Delta Vf$, without problem on residual charges, the required priming voltage only rises by $\Delta Vf$ and that allows driving, and therefore it is possible to achieve an increase in luminous efficiency by a wide gap discharge.

Furthermore, among non-selected cells, only in the cells where a certain amount of residual charges are left, a discharge occurs by the prepriming pulse 124. The ratio of these cells to all the cells is low, and therefore deterioration in contrast brought by the prepriming pulse 124 is considerably low.

Figure 5:
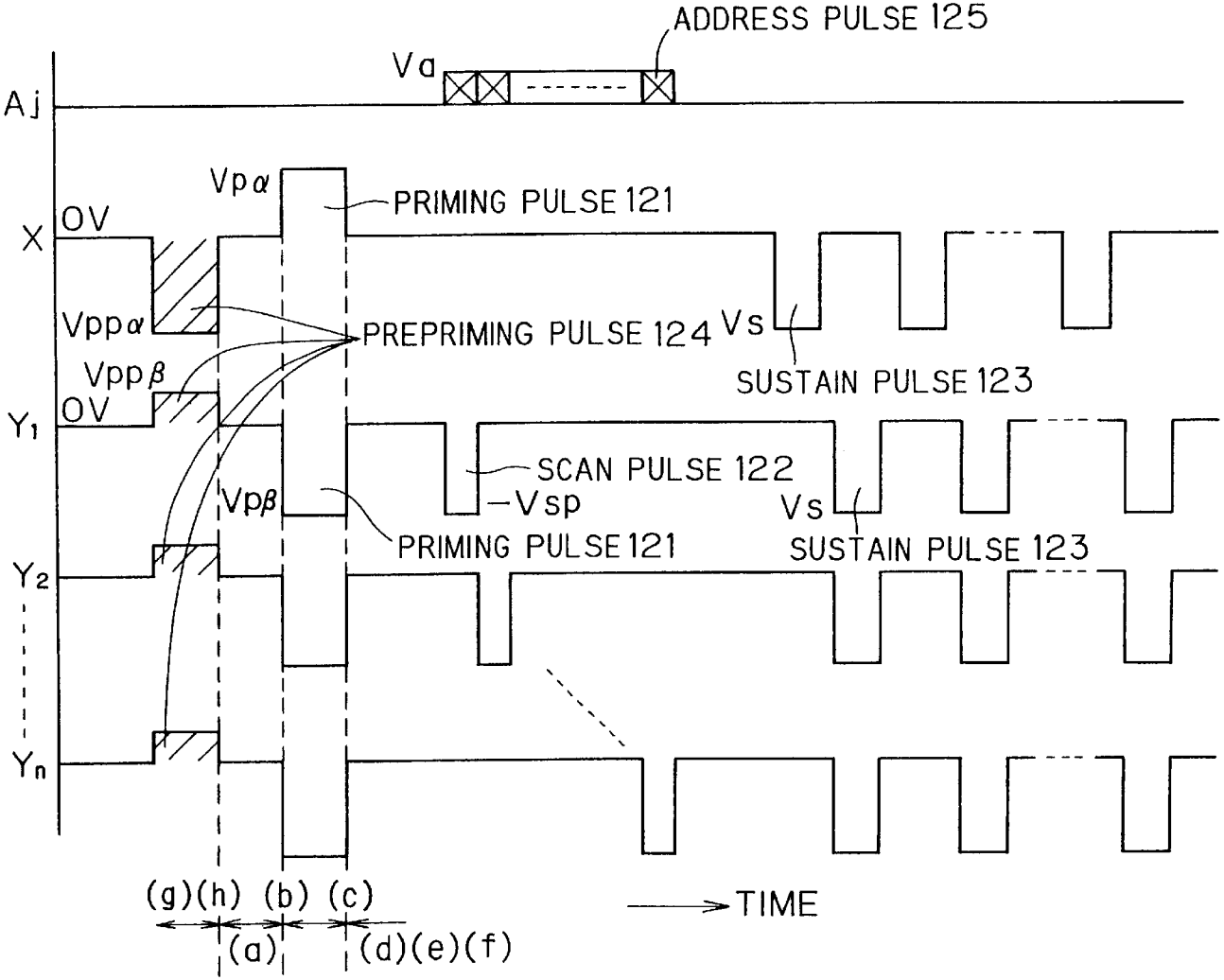
FIG. 5 is an illustration of applied voltage waveforms for showing the method for driving a plasma display in accordance with the first preferred embodiment of the present invention.

The prepriming voltage (the fifth voltage) is a potential difference between the scan electrode Yi and the sustain electrode X. Though the potential Vpp of the prepriming pulse 124 is applied to the scan electrode Yi while keeping the potential of the sustain electrode X zero and therefore the fifth voltage is Vpp in FIG. 2, potentials of reverse polarities may be applied to the sustain electrode X and the scan electrode Yi, as shown in FIG. 5, while maintaining the potential relation among the sustain electrode X, the scan electrode Yi and the address electrode Aj.

At this time, the prepriming pulse generation circuit is provided in the Y common driver 103 as well as in the X common driver 105. The prepriming pulse generation circuits in these drivers generate the above characteristic pulses. These prepriming pulse generation circuits can be each constituted of conventionally-known circuits like the prepriming pulse generation circuit 12 of FIG. 1, and are controlled by the control signal from the control circuit 107.

The prepriming pulse 124 is not necessarily applied before every application of the priming pulses 121 and may be applied intermittently every a plurality of applications of the priming pulse. Though this delays the return from the state for suppressing the priming discharge, even if a voltage higher than the required minimum voltage is applied as the prepriming voltage, frequency of luminescence caused by the prepriming pulse 124 is lowered and the rate of deterioration in contrast is further lowered.

Assume, for example, that based on the subfield gradation method, one field is divided into eight subfields and the priming pulse 121 is applied to the first one of any two subfields. Then, if the prepriming pulse 124 is applied every two priming pulses, the prepriming pulse 124 is inserted once in one filed and the return occurs from the state where the priming discharge is suppressed (abnormal state) to a normal state within one field. It is allowable in a visual check that the abnormal state lasts within about one field.

Though the prepriming pulse 124 is applied every two priming pulses in the above condition, naturally, the insertion is not limited to the above condition and it is applicable, with no problem, that the abnormal state lasts for three fields at most (this corresponds to a case where the prepriming pulse 124 is applied every six priming pulses).

Further, instead of output of being applied immediately before the priming pulse 121, the prepriming pulse 124 may be applied immediately after the priming pulse 121. This case achieves a like effect.

The Second Preferred Embodiment

Figure 6:
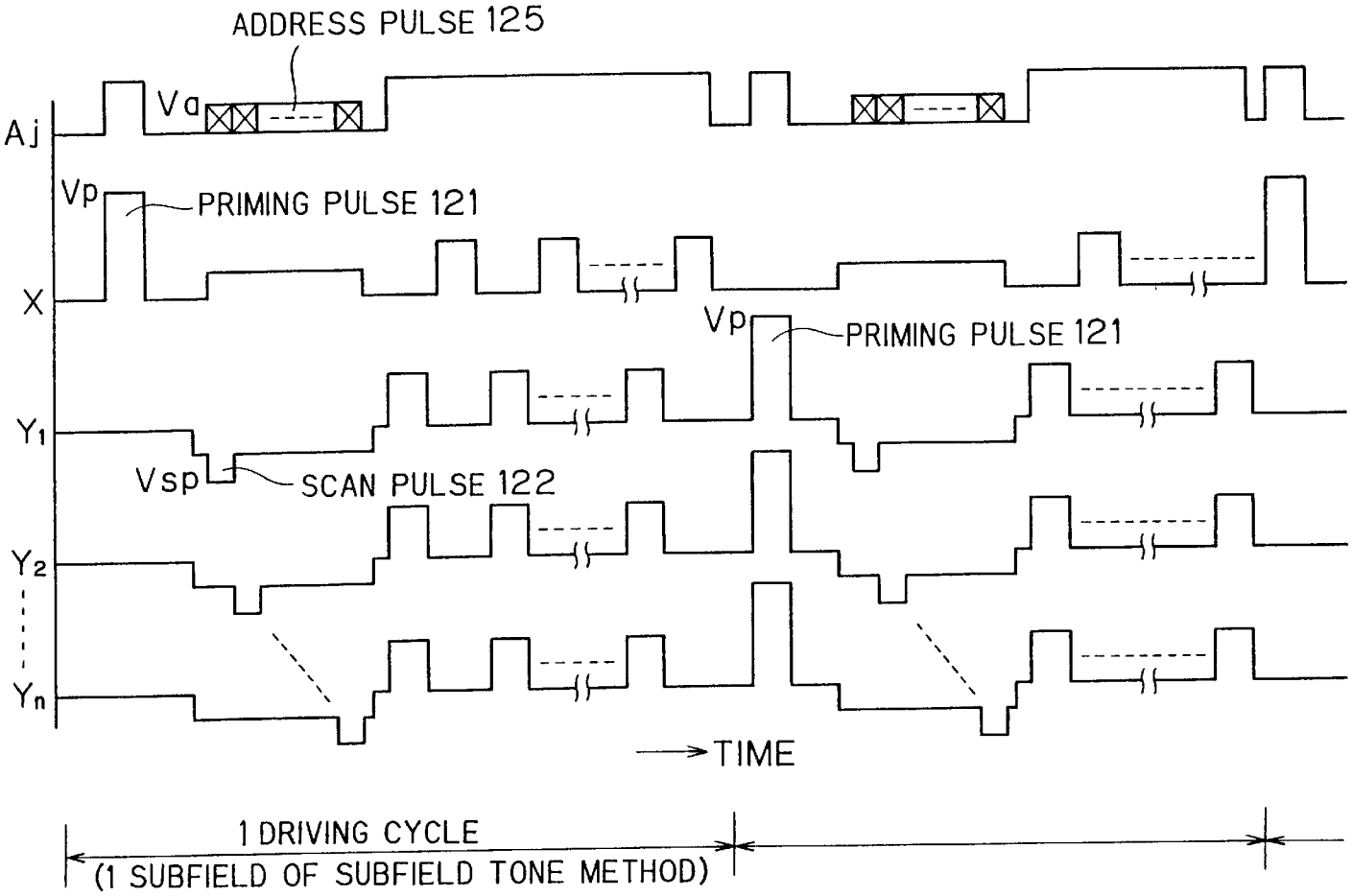
FIG. 6 is an illustration of applied voltage waveforms for showing a method for driving a plasma display in accordance with a second preferred embodiment of the present invention.
Figure 7A:
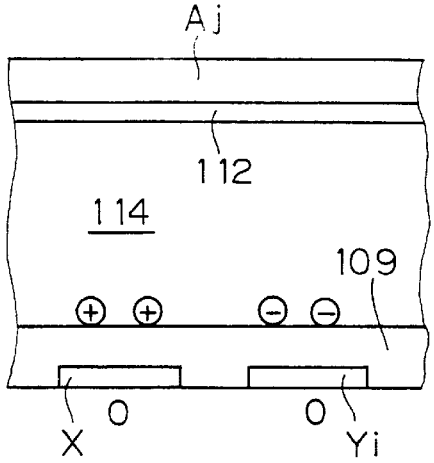
FIGS. 7(*a*) to 7(*k*) illustrate mobility images of residual wall charges for showing a principle of a third preferred embodiment of the present invention.
Figure 7B:
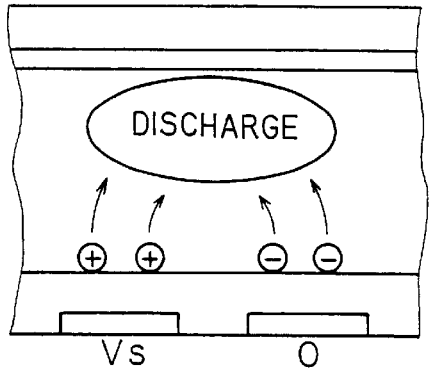
Figure 7C:
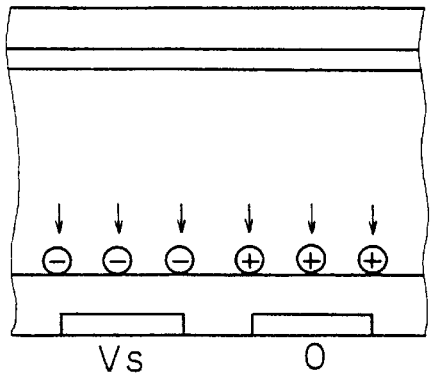
Figure 7D:
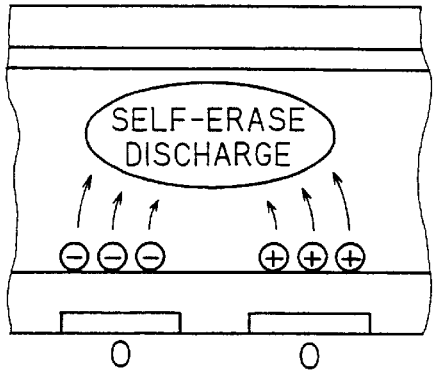
Figure 7E:
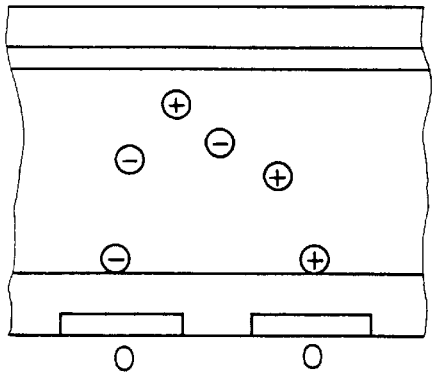
Figure 7F:
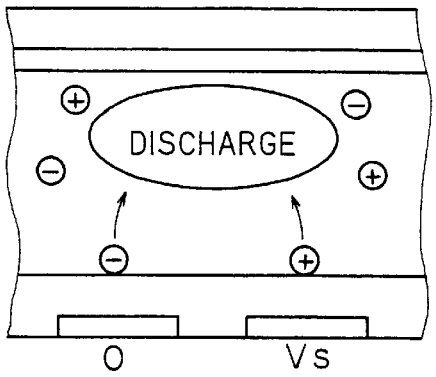
Figure 7G:
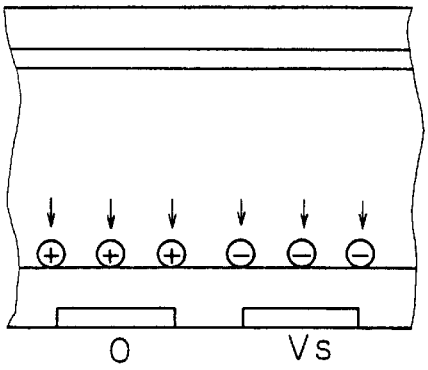
Figure 7H:
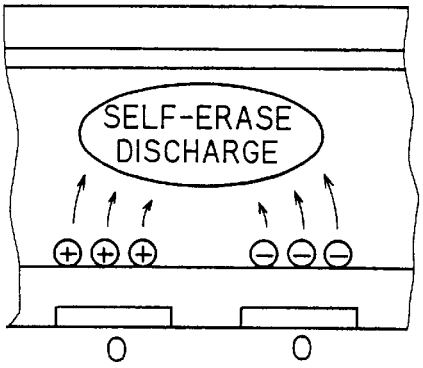
Figure 7I:
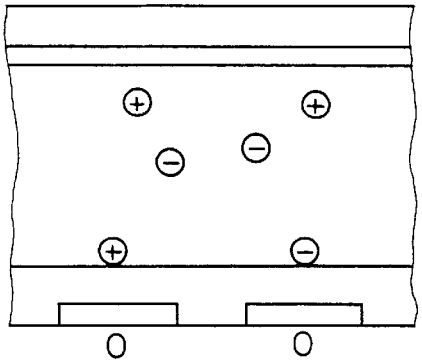
Figure 7J:
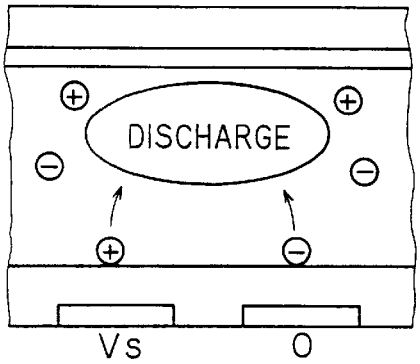
Figure 7K:
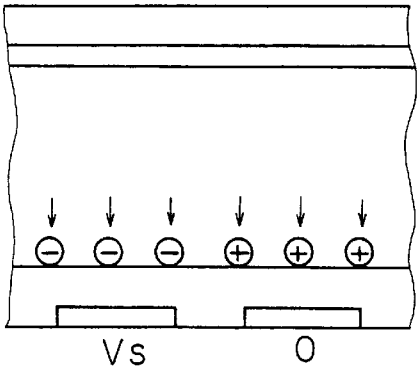

FIG. 6 is an illustration of applied voltage waveforms for showing a method for driving a plasma display in accordance with the second preferred embodiment of the present invention, where the priming pulse 121 is applied alternately to the sustain electrode X and the scan electrode Yi every one driving cycle. In this method, even if the residual wall charges act disadvantageously to the priming pulse 121 causing no priming discharge, in the next driving cycle, since the residual wall charges act advantageously to the priming pulse 121, a priming discharge is surely caused to allow a return to a normal state. The cycle for applying the priming pulse 121 alternately to the sustain electrode X and the scan electrode Yi is not limited to one driving cycle, and the priming pulse 121 may be applied every a plurality of driving cycles or may be applied to the scan electrode Yi every n applications to the sustain electrode X.

Figure 11:
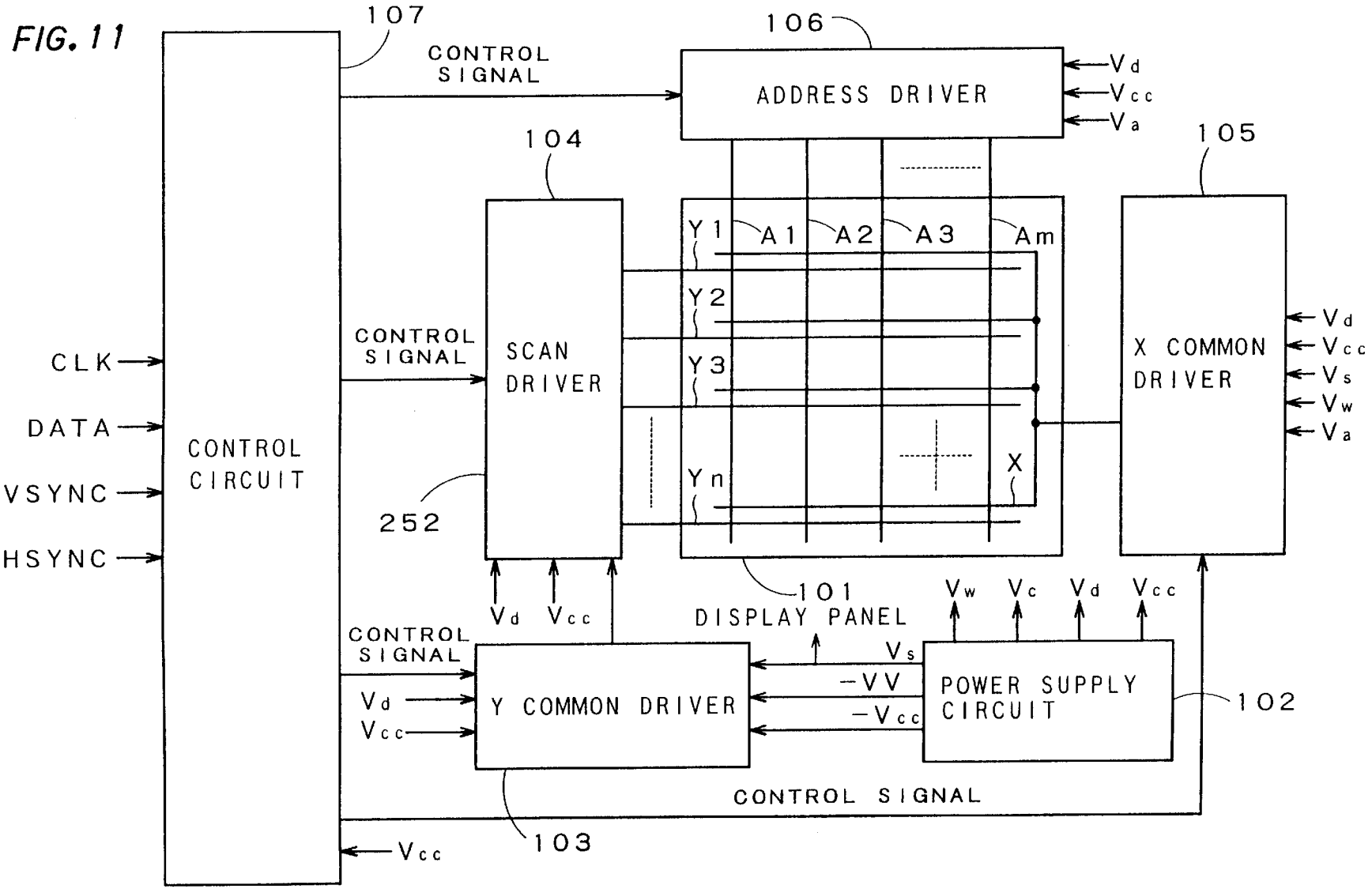
FIG. 11 shows an overview of a configuration of a background-art plasma display.
Figure 12:
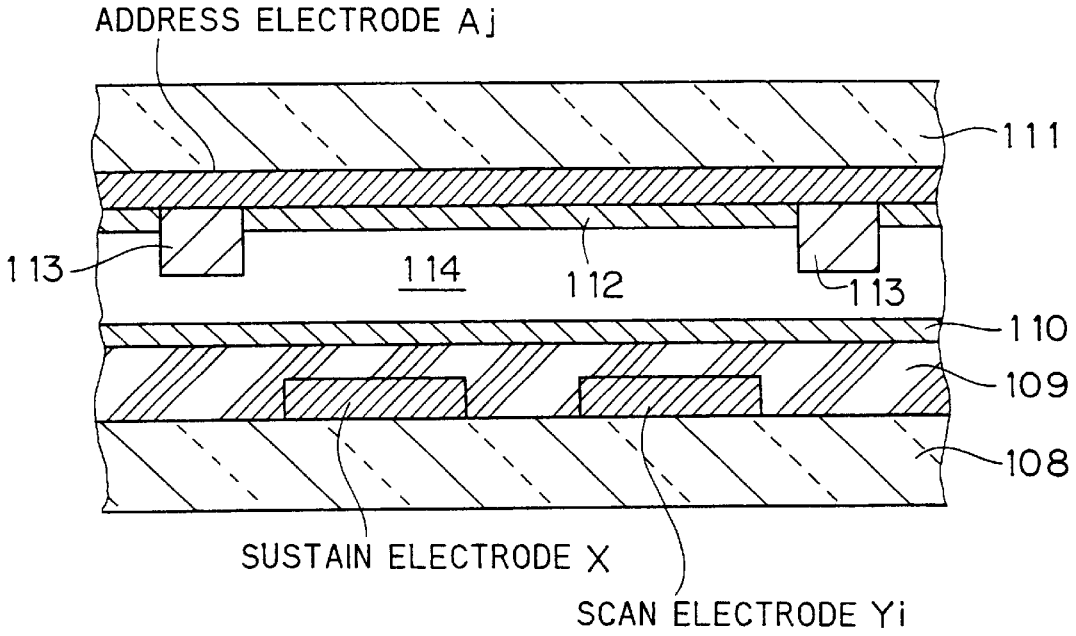
FIG. 12 is a cross section showing a structure of a cell in the plasma display panel.
Figure 13:
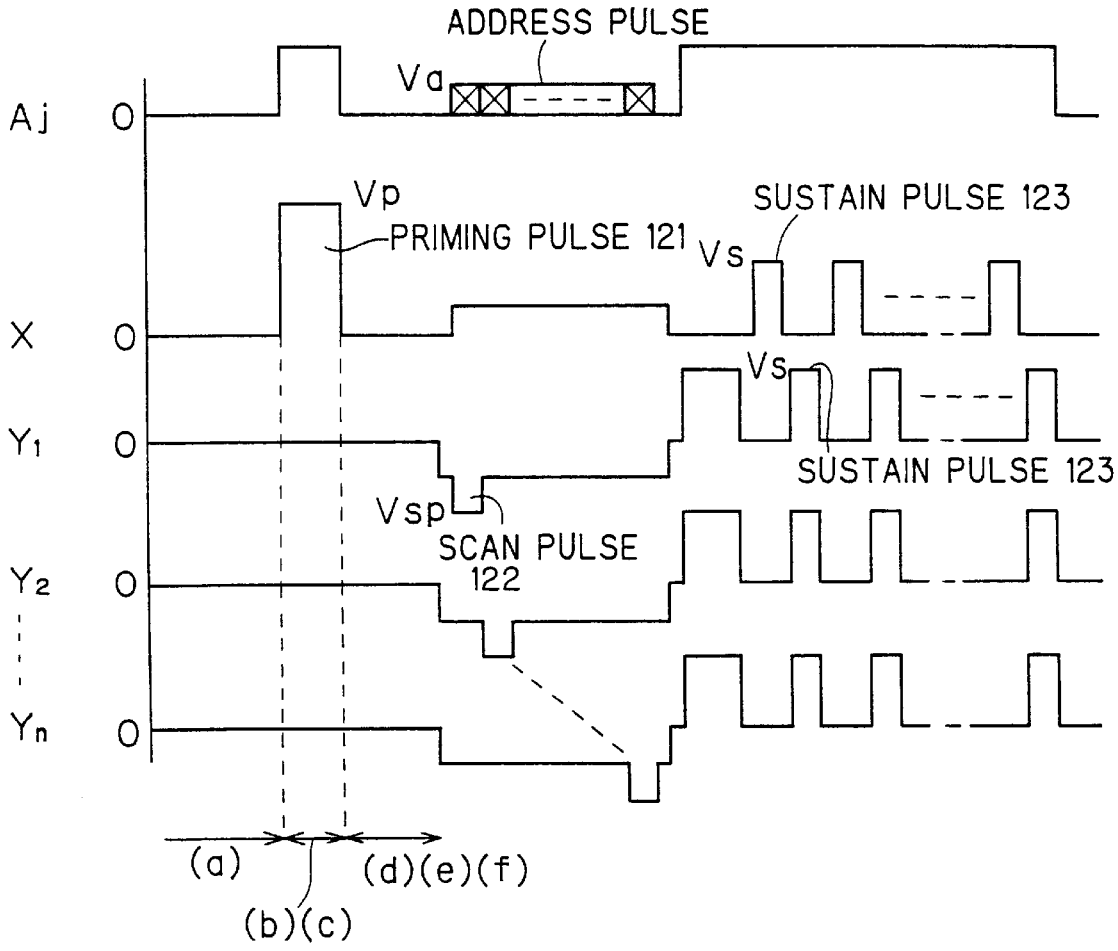
FIG. 13 is an illustration of applied voltage waveforms for showing a background-art method for driving a plasma display.

One method to perform an operation of FIG. 6 is to provide the priming pulse generation circuit in the Y common driver 103 as well as in the X common driver 105 in the background-art plasma display of FIG. 11, where these priming pulse generation circuits generate the above characteristic pulses. The priming pulse generation circuit provided in the Y common driver 103 may also be constituted of conventionally-known circuits and is controlled by the control signal from the control circuit 107.

The Third Preferred Embodiment

FIGS. 7(*a*) to 7(*k*) illustrate a discharge sustaining step of the third preferred embodiment of the present invention, where a self-erase discharge is caused on the fall of the sustain pulse to increase a luminous efficiency. When the sustain voltage Vs is applied to the sustain electrode X after the writing step is finished as shown in FIG. 7(*a*), a discharge occurs as shown in FIG. 7(*b*) and wall charges of reverse polarity to the polarity at the end of writing are produced at portions corresponding to the sustain electrode X and the scan electrode Yi (FIG. 7(*c*)). At this time, with the voltage Vs set sufficiently high, such a large amount of wall charges as the wall voltage exceeds the firing voltage can be accumulated. In this state, when the application of the sustain voltage Vs is stopped, the self-erase discharge is caused by the wall charges. In short, a discharge is also caused by the fall (i.e., trailing edge) of the sustain voltage (FIG. 7(*d*)). Though this discharge reduces the amount of wall charges, with at least several $\mu$s of decay time constant of space charges produced by the self-erase discharge, by reducing the time elapsed before the next rise (i.e., leading edge) of the pulse to not more than 1 $\mu$s, a sustain operation can be continued with the aid of the space charges (FIG. 7(*e*)) produced by the self-erase discharge (FIG. 7(*f*) and figures that follow).

Figure 8:
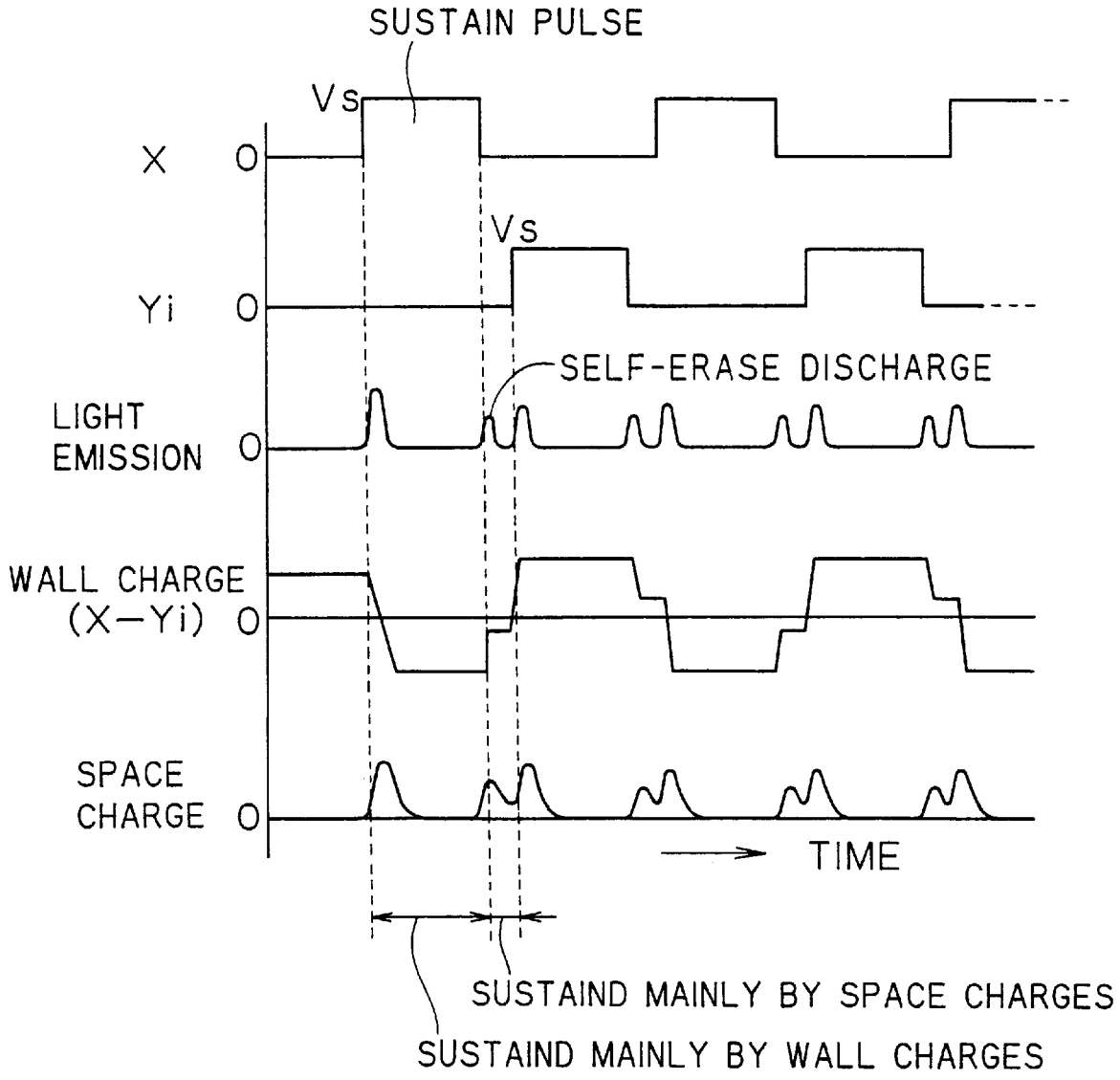
FIG. 8 is a timing chart showing a luminous condition in accordance with the third preferred embodiment of the present invention.

Through the sustaining operation utilizing the self-erase discharge, the discharge occurs to emit light on the fall of the sustain voltage Vs as well as the rise as shown in FIG. 8. Since sustaining is continued by utilizing the space charges produced by the discharge on the fall of the sustain pulse, it is possible to continue sustaining even by not too high voltage of the sustain pulse that is applied next and relatively weaken the luminance on the rise of the sustain pulse. As a result, weak discharges are repeated twice as much as in the background art, to increase the luminous efficiency.

The characteristic feature of the above operation is laid in that the self-erase discharge is caused to intentionally suppress the discharge on the next rise of the sustain pulse. The method for causing the self-discharge (self-erase discharge) in the discharge sustaining step is shown in Japanese Patent Application Laid Open Gazette 8-314405, where it is possible to increase in luminance without increasing the number of applications of the discharge sustaining voltage. In this technique, however, since the inactive period of the sustain pulse is about 1 to 1.5 $\mu$s and the space charges produced by the self-erase discharge is not effectively utilized, there arises a necessity for setting the sum of the wall voltage after the self-discharge and the externally-applied voltage to exceed the firing voltage and the intensity of one discharge becomes relatively high. As a result, the luminance is increased but the luminous efficiency is not increased. In the present invention, by actively utilizing the space charges produced by the self-erase discharge, it becomes possible to weaken the discharge on the rise of the sustain pulse and consequently the luminous efficiency can be increased though the luminance is not sufficiently increased.

Figure 9A:
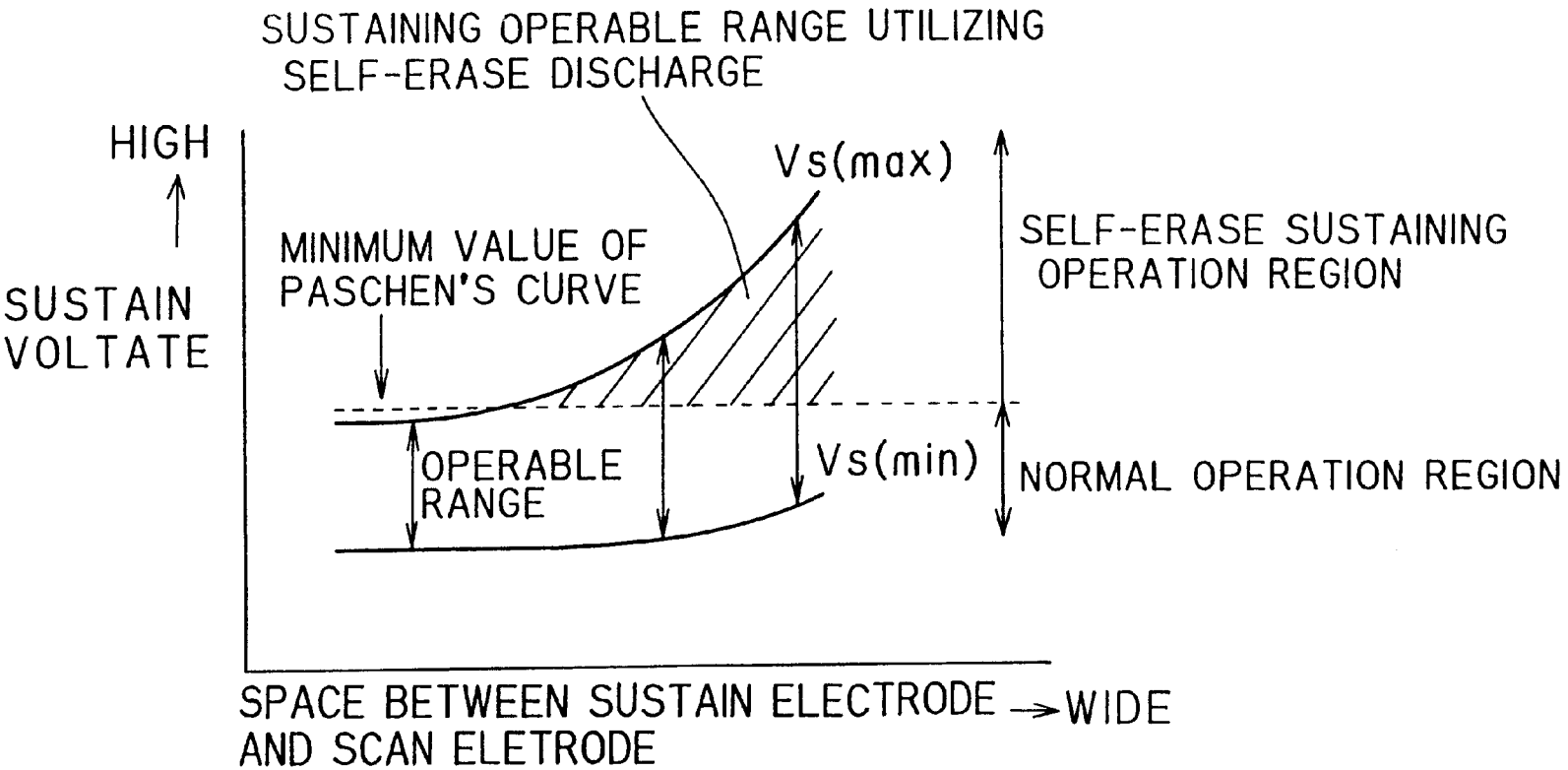
FIGS. 9A and 9B shows a relation between the space between electrodes and the sustain voltage.
Figure 9B:
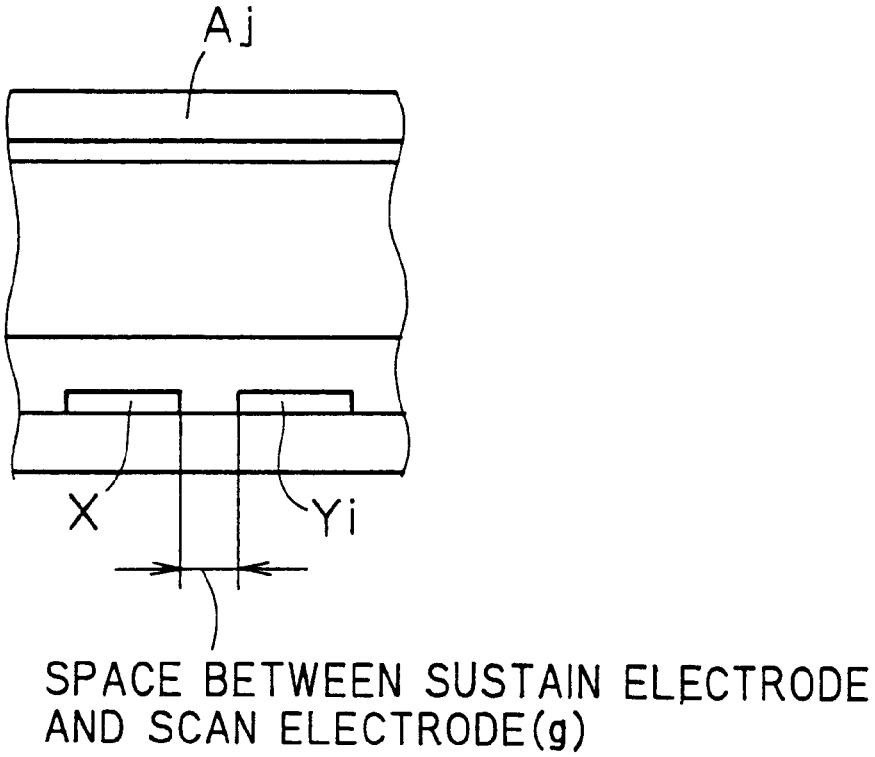

One method to perform this operation in such an operation region is to set the value of (gas pressure)×(space between the sustain electrode and the scan electrode) to exceed the minimum value of the usually-used Paschen's curve. For example, when the space is widen with the gas pressure constant or the partial pressure ratio of Xe in the Penning mixed gas of Ne and Xe is increased, the maximum value of the voltage in a sustaining operable range is shifted upward and the self-erase sustaining operation region is included in the sustaining operable region as shown in FIGS. 9A and 9B. On the other hand, the minimum value of the voltage in a sustaining operable range is also shifted upward but the rise of the voltage is relatively gradual since the space charges produced by the self-erase discharge on the fall of the sustain pulse are utilized for the next rise of the sustain pulse. As a result, high efficient driving can be performed by utilizing the selferase discharge in a wide range of the sustain voltage.

Figure 10:
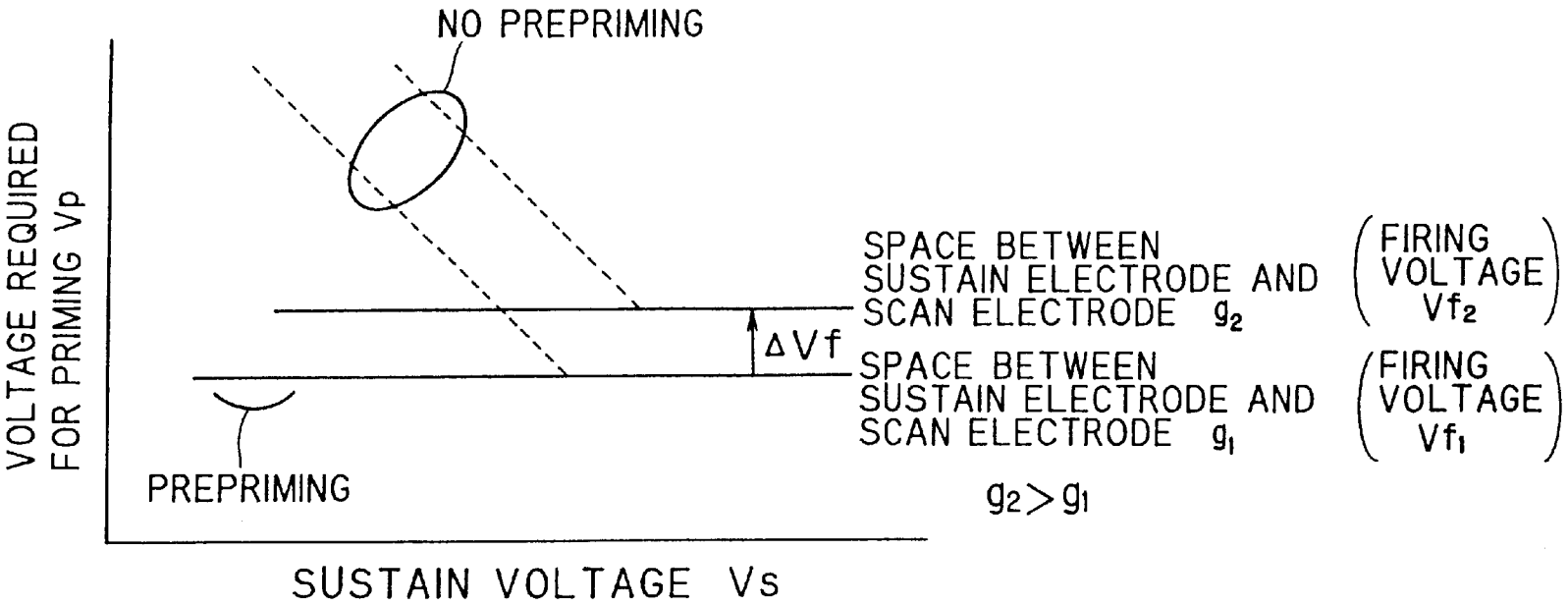
FIG. 10 shows a relation between the sustain voltage and the priming voltage.

To perform a stable operation including the priming discharge in a region with wide space, it is effective to insert the prepriming pulse 124 as discussed in the first preferred embodiment. By inserting the prepriming pulse 124, the priming discharge in the resetting step can be surely performed and the minimum value of the required priming voltage rises by only $\Delta Vf$, as shown in FIG. 10, regardless of the sustain voltage Vs, even if the space is widened from g1 to g2 and the firing voltage is increased from Vf1 to Vf2 (where $Vf2-Vf1=\Delta Vf$).

One method to achieve the operation of this preferred embodiment is that the X common driver 105 and the Y common driver 103 perform the above characteristic operation in the background-art plasma display of FIG. 11. The control circuit 107 generates and outputs the control signal so that the X common driver 105 and the Y common driver 103 may perform the above characteristic operation.

While the invention has been shown and described in detail, the foregoing description is in all aspects illustrative and not restrictive. It is therefore understood that numerous modifications and variations can be devised without departing from the scope of the invention.

I claim:

1. A method for driving a plasma display, said plasma display having first and second substrates respectively defining first and second surfaces facing each other, electrode pairs disposed on said first surface and respectively defining parallel display lines, each of said electrode pairs pairing first and second electrodes parallel to each other, a dielectric layer covering said first and second electrodes for accumulation of wall charges on a surface thereof, said dielectric layer defining a space between said surface thereof and said second surface, and third electrodes disposed on said second surface and intersecting said electrode pairs without contact, wherein said space is filled with a discharge gas and discharge cells are respectively defined at intersections of said electrode pairs and said third electrodes, said method comprising a repeating step of repeatedly executing a cycle, said cycle including:

a resetting step of applying a pulse of a first voltage across said first and second electrodes so as to cause a discharge;

a writing step of applying a pulse of a second voltage across said second electrode of one of said electrode pairs and one of said third electrodes corresponding to one of said cells to be turned on so as to cause a discharge and thereby accumulate first and second wall charges, which are reversed in polarity to each other and define a third voltage thereacross, on portions of said surface of said dielectric layer respectively over said first and second electrodes of said one of said electrode pairs; and a discharge sustaining step of applying an AC voltage pulse as a pulse of a fourth voltage across said first and second electrodes belonging to each one of said electrode pairs to thereby turn on any one of said cells where sum of said third and fourth voltages having same polarity exceeds a firing voltage defined across said first and second electrodes of each one of said electrode pairs and sustain discharge at said any one of cells alternately changing polarity of said first and second wall charges in response to alternate change of said fourth pulse in polarity, and said method further comprising:

an inserting step of inserting a prepriming step into said cycle, said prepriming step being a step of applying a pulse of a fifth voltage across said first and second electrodes belonging to each one of said electrode pairs simultaneously among a plurality of said pairs after said discharge sustaining step and before said writing step, wherein said fifth voltage is in a range between said first and fourth voltage and is reverse to said first voltage in polarity.

2. The method of claim 1, wherein in said inserting step, said prepriming step is inserted immediately before said resetting step.

3. A method for driving a plasma display, said plasma display having first and second substrates respectively defining first and second surfaces facing each other, electrode pairs disposed on said first surface and respectively defining parallel display lines, each of said electrode pairs pairing first and second electrodes parallel to each other, a dielectric layer covering said first and second electrodes for accumulation of wall charges on a surface thereof, said dielectric layer defining a space between said surface thereof and said second surface, and third electrodes disposed on said second surface and intersecting said electrode pairs without contact, wherein said space is filled with a discharge gas and discharge cells are respectively defined at intersections of said electrode pairs and said third electrodes, said method comprising a repeating step of repeatedly executing a cycle, said cycle including:

a resetting step of applying a pulse of a first voltage across said first and second electrodes so as to cause a discharge;

a writing step of applying a pulse of a second voltage across said second electrode of one of said electrode pairs and one of said third electrodes corresponding to one of said cells to be turned on so as to cause a discharge and thereby accumulate first and second wall charges, which are reverse in polarity to each other and define a third voltage thereacross, on portions of said surface of said dielectric layer respectively over said first and second electrodes of said one of said electrode pairs; and a discharge sustaining step of applying an AC voltage pulse as a pulse of a fourth voltage across said first and second electrodes belonging to each one of said electrode pairs to thereby turn on any one of said cells where sum of said third and fourth voltages having same polarity exceeds a firing voltage defined across said first and second electrodes of each one of said electrode pairs and sustain discharge at said any one of cells alternately changing polarity of said first and second wall charges in response to alternate change of said fourth pulse in polarity, and said method further comprising:

an inserting step of inserting a prepriming step into said cycle, said prepriming step being a step of applying a pulse of a fifth voltage across said first and second electrodes belonging to each one of said electrode pairs after said discharge sustaining step and before said writing step wherein said fifth voltage is in a range between said first and fourth voltage and is reverse to said first voltage in polarity, wherein in said inserting step, said prepriming step is inserted immediately before said resetting step, and wherein said fifth voltage is lower than said firing voltage.

4. The method of claim 3, wherein a sum of said first and fifth voltage is at least twice as large as said firing voltage.

5. The method of claim 3, wherein said pulse of said fourth voltage applied immediately before application of said pulse of said fifth voltage is reverse to said pulse of said fifth voltage in polarity.

6. The method of claim 3, wherein in said inserting step, said prepriming step is inserted intermittently in repetition of said cycle.

7. The method of claim 6, wherein in said inserting step, said prepriming step is inserted every two to six cycles.

8. A method for driving a plasma display, said plasma display having first and second substrates respectively defining first and second surface facing each other, electrode pairs disposed on said first surface and respectively defining parallel display lines, each of said electrode pairs pairing first and second electrodes parallel to each other, a dielectric layer covering said first and second electrodes for accumulation of wall charges on a surface thereof, said dielectric layer defining a space between said surface thereof and said second surface, and third electrodes disposed on said second surface and intersecting said electrode pairs without contact, wherein said space is filled with a discharge gas and discharge cells are respectively defined at intersections of said electrode pairs and said third electrodes, said method comprising a repeating step of repeatedly executing a cycle, said cycle including:

a resetting step of applying a pulse of a first voltage across said first and second electrodes so as to cause a discharge;

a writing step of applying a pulse of a second voltage across said second electrode of one of said electrode pairs and one of said third electrodes corresponding to one of said cells to be turned on so as to cause a discharge and thereby accumulate first and second wall charges, which are reverse in polarity to each other and define a third voltage thereacross, on portions of said surface of said dielectric layer respectively over said first and second electrodes of said one of said electrode pairs; and a discharge sustaining step of applying an AC voltage pulse as a pulse of a fourth voltage across said first and second electrodes belonging to each one of said electrode pairs to thereby turn on any one of said cells where sum of said third and fourth voltages having same polarity exceeds a firing voltage defined across said first and second electrodes of each one of said electrode pairs and sustain discharge at said any one of cells alternately changing polarity of said first and second wall charges in response to alternate change of said fourth pulse in polarity, and said method further comprising:

an polarity changing step of changing said first voltage in polarity during said repeating step alternately.

9. The method of claim 8, wherein in said polarity changing step, said first voltage is changed every N ($\geqq 1$) cycles alternately.

10. The method of claim 8, wherein in said polarity changing step, said first voltage is changed every N ($\geqq 2$) cycles from a first to a second polarity, and is returned from said second to said first polarity one cycle after.

11. The method of claim 8 wherein said polarity changing step inverts the net polarity of the first voltage applied across the first and second electrodes during said resetting step in different repeating steps.

12. The method of claim 11 wherein said net polarity is inverted each N cycles of said repeating step, where N is greater than one.

13. A method for driving a plasma display, said plasma display having first and second substrates respectively defining first and second surface facing each other, electrode pairs disposed on said first surface and respectively defining parallel display lines, each of said electrode pairs pairing first and second electrodes parallel to each other, a dielectric layer covering said first and second electrodes for accumulation of wall charges on a surface thereof, said dielectric layer defining a space between said surface thereof and said second surface, and third electrodes disposed on said second surface and intersecting said electrode pairs without contact, wherein said space is filled with a discharge gas and discharge cells are respectively defined at intersections of said electrode pairs and said third electrodes, said method comprising a repeating step of repeatedly executing a cycle, said cycle including:

a resetting step of applying a pulse of a first voltage across said first and second electrodes so as to cause a discharge;

a writing step of applying a pulse of a second voltage across said second electrode of one of said electrode pairs and one of said third electrodes corresponding to one of said cells to be turned on so as to cause a discharge and thereby accumulate first and second wall charges, which are reverse in polarity to each other and define a third voltage thereacross, on portions of said surface of said dielectric layer respectively over said first and second electrodes of said one of said electrode pairs; and a discharge sustaining step of applying an AC voltage pulse as a pulse of a fourth voltage across said first and second electrodes belonging to each one of said electrode pairs to thereby turn on any one of said cells where sum of said third and fourth voltages having same polarity exceeds a firing voltage defined across said first and second electrodes of each one of said electrode pairs and sustain discharge at said any one of cells alternately changing polarity of said first and second wall charges in response to alternate change of said fourth pulse in polarity, wherein said fourth voltage is so set that said first and second wall charges caused by an application of said pulse of said fourth voltage define a voltage thereacross higher than said firing voltage, and a period from a trailing edge to a leading edge of said AC voltage pulse is set shorter than a decay time constant of space charges produced by a discharge arising at said trailing edge.

14. The method of claim 13, wherein said period is set not more than 1 $\mu$sec.

15. The method of claim 11, further comprising:

an adjusting step of adjusting a product of a distance between said first and second electrodes and a pressure of said discharge gas to a value exceeding Paschen's minimum firing voltage prior to said repeating step.

16. The method of claim 11, further comprising:

an inserting step of inserting a prepriming step into said cycle, said prepriming step being a step of applying a pulse of a fifth voltage across said first and second electrodes belonging to each one of said electrode pairs after said discharge sustaining step and before said writing step, wherein said fifth voltage is in a range between said first and fourth voltage and is reverse to said first voltage in polarity.

17. The method of claim 16, wherein in said inserting step, said prepriming step is inserted immediately before said resetting step.

18. A method for driving a plasma display, said plasma display having first and second substrates respectively defining first and second surfaces facing each other, electrode pairs disposed on said first surface and respectively defining parallel display lines, each of said electrode pairs pairing first and second electrodes parallel to each other, a dielectric layer covering said first and second electrodes for accumulation of wall charges on a surface thereof, said dielectric layer defining a space between said surface thereof and said second surface, and third electrodes disposed on said second surface and intersecting said electrode pairs without contact, wherein said space is filled with a discharge gas and discharge cells are respectively defined at intersections of said electrode pairs and said third electrodes, said method comprising a repeating step of repeatedly executing a cycle, said cycle including:

a resetting step of making uniform a state of said wall charges among all the cells;

a writing step of changing a state of said wall charges in a selected one of said cells; and a discharge sustaining step of applying an AC voltage pulse as a pulse of a voltage across said first and second electrodes belonging to each one of said electrode pairs while alternately changing polarity of said pulse of said voltage, wherein said voltage is set so that wall charges caused by an application of said pulse of said voltage define a voltage there across higher than a firing voltage defined across said first and second electrodes belonging to each one of said electrode pairs, and a period from a trailing edge to a leading edge of said AC voltage pulse is set shorter than a decay time constant of space charges produced by a discharge arising at said trailing edge.

* * * * *